US009448502B2

(12) United States Patent
Taniguchi et al.

(10) Patent No.: US 9,448,502 B2
(45) Date of Patent: Sep. 20, 2016

(54) CHARGING MEMBER, PROCESS CARTRIDGE AND ELECTROPHOTOGRAPHIC APPARATUS

(71) Applicant: CANON KABUSHIKI KAISHA, Tokyo (JP)

(72) Inventors: Tomohito Taniguchi, Suntou-gun (JP); Taichi Sato, Numazu (JP); Atsushi Uematsu, Fuji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 182 days.

(21) Appl. No.: 14/336,917

(22) Filed: Jul. 21, 2014

(65) Prior Publication Data

US 2014/0334843 A1 Nov. 13, 2014

Related U.S. Application Data

(63) Continuation of application No. PCT/JP2014/000248, filed on Jan. 20, 2014.

(30) Foreign Application Priority Data

Jan. 29, 2013 (JP) ..... 2013-014859

(51) Int. Cl.
*G03G 15/02* (2006.01)
*G03G 21/18* (2006.01)

(52) U.S. Cl.
CPC ..... *G03G 15/0233* (2013.01); *G03G 21/18* (2013.01)

(58) Field of Classification Search
CPC ..... G03G 15/0806; G03G 15/08018; G03G 2215/00679; G03G 2215/025; G03G 2215/2058; G03G 15/2053; G03G 15/2057; G03G 15/6552; Y10T 29/49565; Y10T 29/4956
USPC ..... 492/18, 53, 56, 59, 30, 31, 33, 35, 36
See application file for complete search history.

(56) References Cited

U.S. PATENT DOCUMENTS 6,908,419 B2 * 6/2005 Takashima ..... G03G 15/0233 492/49
7,835,669 B2 11/2010 Furukawa et al.
8,991,053 B2 * 3/2015 Watanabe ..... B05D 5/00 29/895.3

(Continued)

FOREIGN PATENT DOCUMENTS

JP 2008-276024 A 11/2008
JP 2010-134431 A 6/2010

(Continued)

OTHER PUBLICATIONS

U.S. Appl. No. 14/338,107, filed Jul. 22, 2014. Applicant: Taichi Sato, et al.
International Preliminary Report on Patentability, International Application No. PCT/JP2014/000248, Mailing Date Aug. 13, 2015.

*Primary Examiner* — Jason L Vaughan
(74) *Attorney, Agent, or Firm* — Fitzpatrick, Cella, Harper & Scinto

(57) ABSTRACT

A charging member including an electro-conductive substrate, an electro-conductive elastic layer, and an electro-conductive surface layer, wherein the elastic layer includes a polymer having a unit derived from ethylene oxide and at least one particle selected from the group consisting of graphite particles and graphitized particles; wherein a particle-exposing portion where the particle is exposed is present on the surface of the elastic layer; the surface of the elastic layer including the particle-exposing portions is coated with the surface layer; the surface layer includes binder resin and resin particles dispersed in the binder resin and has a plurality of protrusions derived from the resin particles on the surface; when the resin particles in the surface layer are orthographically projected onto the surface of the elastic layer, areas other than projected areas of the resin particles on the surface of the elastic layer overlap the particle-exposing portion.

12 Claims, 3 Drawing Sheets

(56) References Cited

U.S. PATENT DOCUMENTS

| | | | |
|---|---|---|---|
| 2010/0166454 | A1 | 7/2010 | Taniguchi et al. |
| 2014/0234764 | A1 | 8/2014 | Aoyama et al. |
| 2014/0270853 | A1 | 9/2014 | Uematsu et al. |

FOREIGN PATENT DOCUMENTS

| | | | |
|---|---|---|---|
| JP | 2010-134452 | A | 6/2010 |
| JP | 2012-118322 | A | 6/2012 |
| JP | 2012-168259 | A | 9/2012 |

* cited by examiner

CHARGING MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2014/000248, filed Jan. 20, 2014, which claims the benefit of Japanese Patent Application No. 2013-014859, filed Jan. 29, 2013.

BACKGROUND OF THE INVENTION

1. Field of the Invention

The present invention relates to a charging member for charging the surface of an electrophotographic photosensitive member as a member to be charged up to a predetermined potential by applying voltage, and a process cartridge and electrophotographic image forming apparatus (hereinafter referred to as an "electrophotographic apparatus") using the charging member.

2. Description of the Related Art

Electrophotographic apparatuses often employ a contact charging method as a method of charging a surface of an electrophotographic photosensitive member, in which voltage is applied to a charging member disposed in contact with or in the vicinity of the surface of the electrophotographic photosensitive member to charge the surface of the electrophotographic photosensitive member. Here, examples of the voltage to be applied include only DC voltage or AC voltage superimposed onto DC voltage.

As a charging member used for the contact charging method, Japanese Patent Application Laid-Open No. 2010-134452 discloses a charging roller including a surface layer having protrusions derived from resin particles and protrusions derived from graphite particles on the surface of the surface layer wherein the number of the protrusions derived from a graphite particle having a positive distance between each protrusion derived from a graphite particle and a plane containing vertexes of three protrusions derived from the resin particles adjacent to the protrusion derived from a graphite particle is 80% or more of the total number of the protrusions derived from graphite particles. Japanese Patent Application Laid-Open No. 2010-134452 also discloses that the charging roller attains uniform charging potential of an electrophotographic photosensitive member to form a high-quality electrophotographic image.

SUMMARY OF THE INVENTION

The present inventors found that the charging member described in Japanese Patent Application Laid-Open No. 2010-134452 is effective for uniform charging potential of the electrophotographic photosensitive member. However, further research by the present inventors revealed another problem to be solved. Namely, if the charging member has an electrically conductive layer (hereinafter also referred to as an "electro-conductive elastic layer") which contains a polymer having a unit derived from ethylene oxide such as epichlorohydrin rubber and is disposed immediately below the surface layer of the charging member, a difference in electric resistance caused at the interface between the surface layer and the electro-conductive elastic layer may reduce discharge intensity to an electrophotographic photosensitive member.

Such a reduction over time in discharge intensity may cause defects in the electrophotographic image. For example, the contact charging method includes a charging method for applying a voltage of AC voltage superimposed onto DC voltage to the charging member (hereinafter referred to as an "AC DC superimposing charging method"). If such an AC DC superimposing charging method is employed, and the discharge intensity from the charging member to the electrophotographic photosensitive member reduces, interference fringes may be produced in the electrophotographic image. The electrophotographic image having interference fringes is also referred to as a "moire image" in some cases. The "moire image" is produced for the following reason. Namely, due to the reduction in the discharge intensity from the charging member to the electrophotographic photosensitive member, the surface of the electrophotographic photosensitive member is charged in a pattern of cycle corresponding to the cycle of the AC voltage applied to the charging member. If the thus-charged surface of the electrophotographic photosensitive member is exposed to output an halftone image in which horizontal lines are drawn in a direction perpendicular to the rotational direction of the electrophotographic photosensitive member (for example, a width of 1 dot and an interval of 2 dots, or a width of 1 dot and an interval of 3 dots), a portion charged in the charging cycle pattern interferes with a portion having a potential changed by the exposure for forming the halftone image, resulting in the "moire image." Accordingly, the moire produced in the halftone image can be an index indicating a reduction in discharge intensity.

Then, the present invention is directed to providing a charging member having high charging performance to an electrophotographic photosensitive member and reducing change over time in the charging performance.

The present invention is directed to providing a process cartridge and electrophotographic apparatus useful for stable formation of a high-quality electrophotographic image.

According to one aspect of the present invention, there is provided a charging member comprising: an electro-conductive substrate, an electro-conductive elastic layer, and an electro-conductive surface layer, wherein, the elastic layer comprises: a polymer having a unit derived from ethylene oxide, and at least one particle selected from the group consisting of graphite particles and graphitized particles, wherein, a particle-exposing portion where one or both of the particles selected from the group consisting of the graphite particles and the graphitized particles is exposed, is present on a surface of the elastic layer, the surface of the elastic layer including the particle-exposing portions where one or both of the particles selected from the group consisting of the graphite particles and the graphitized particles is exposed, is coated with the surface layer, the surface layer comprises: a binder resin, and resin particles dispersed in the binder resin, and has a plurality of protrusions derived from the resin particles on the surface of the surface layer, and wherein, when the resin particles in the surface layer are orthographically projected onto the surface of the elastic layer, areas other than projected areas of the resin particles on the surface of the elastic layer overlap the particle-exposing portions where one or both of the particles selected from the group consisting of the graphite particles and the graphitized particles is exposed on the surface of the elastic layer.

According to another aspect of the present invention, there is provided a process cartridge, comprising the charging member integrated with a charged member, wherein the process cartridge is detachably mountable to a main body of an electrophotographic apparatus.

According to further aspect of the present invention, there is provided an electrophotographic apparatus comprising the charging member, and an electrophotographic photosensitive member disposed to be chargeable with the charging member.

The present invention can provide a charging member having high charging performance and reducing change over time in the charging performance. Moreover, the present invention can provide a process cartridge and an electrophotographic apparatus useful for stable formation of a high-quality electrophotographic image.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
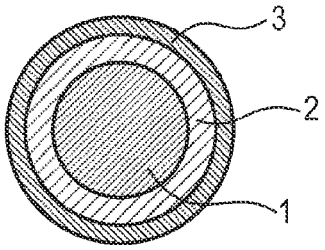
FIG. 1A is a sectional view illustrating a charging member having a roller shape according to the present invention.
Figure 1B:
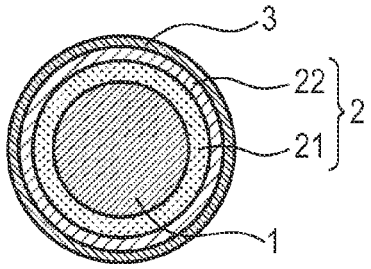
FIG. 1B is a sectional view illustrating a charging member having a roller shape according to the present invention.

FIG. 1A shows one example of a cross section of the charging member according to the present invention. The charging member includes an electro-conductive substrate 1, an electro-conductive elastic layer 2 applied to the circumferential surface of the substrate, and an electro-conductive surface layer 3. The charging member may have two or more electro-conductive elastic layers as shown in FIG. 1B.

The electro-conductive substrate may be bonded to a layer sequentially laminated on the electro-conductive substrate (such as the electro-conductive elastic layer 2 shown in FIG. 1A, and the electro-conductive elastic layer 21 shown in FIG. 1B) with an electro-conductive adhesive. A known electro-conductive agent can be used as the adhesive to give conductivity. The electro-conductive adhesive can also be used to bond the electro-conductive elastic layer 21 to the electro-conductive elastic layer 22 shown in FIG. 1B.

Figure 2:
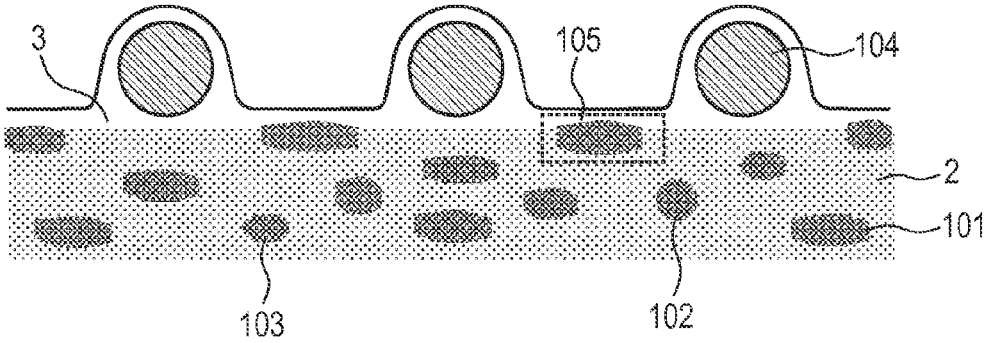
FIG. 2 is a partial sectional view illustrating a charging member according to the present invention.

FIG. 2 is an enlarged cross section of the electro-conductive elastic layer (hereinafter simply referred to as an "elastic layer" in some cases) and the electro-conductive surface layer (hereinafter simply referred to as a "surface layer"). The elastic layer 2 contains a polymer having a unit derived from ethylene oxide and one or both of the particles (101, 102, and 103) selected from the group consisting of graphite particles and graphitized particles, and has particle-exposing portions where one or both of the particles selected from the group consisting of graphite particles and graphitized particles is exposed (such as 105) on the surface of the elastic layer. The surface of the elastic layer including the particle-exposing portions is coated with the surface layer 3. Moreover, the surface layer 3 includes a binder resin and resin particles 104, and has a plurality of protrusions derived from the resin particles on the surface of the surface layer.

Figure 3:
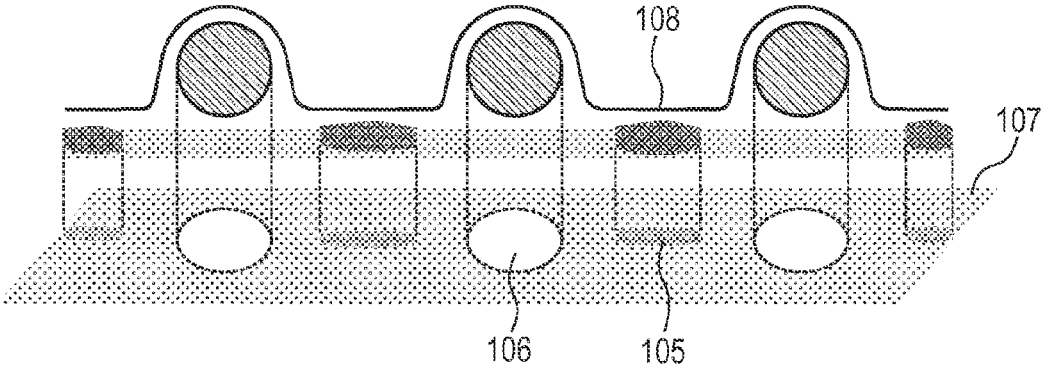
FIG. 3 is a schematic view illustrating a positional relationship between projected areas of the resin particles and particle-exposing portions where graphite particles or the like are exposed when resin particles in an electro-conductive surface layer according to the present invention are orthographically projected onto the surface of the electro-conductive elastic layer.

FIG. 3 is a schematic view showing the resin particles in the surface layer orthographically projected onto the surface of the elastic layer. The particle-exposing portions where one or both of the particles selected from the group consisting of graphite particles and graphitized particles (such as 105) is exposed, are present on a surface 107 of the elastic layer. Here, the projected area when the resin particles in the surface layer are orthographically projected onto the surface of the elastic layer is, for example, a region 106. In the charging member according to the present invention, areas other than the projected areas (such as areas other than the portion 106) overlap the particle-exposing portions where one or both of the particles selected from the group consisting of graphite particles and graphitized particles is exposed (such as 105).

The present inventors studied the discharging state when the charging member charged the electrophotographic photosensitive member. During the process, the inventors observed the discharging state of the nip portion between the charging member and the electrophotographic photosensitive member in detail. As a result, the charging member having the protrusion derived from the resin particles or the like produces a slight gap within the nip between the electrophotographic photosensitive member and the charging member. The inventors found that in the discharging step, discharge from the charging member to the electrophotographic photosensitive member occurs in the gap, resulting in stable charging. Hereinafter, the discharge occurring in the slight gap produced within the nip is also referred to as "discharge within the nip."

However, if the electrophotographic image is formed for a long period of time, the discharge within the nip may be difficult to occur. Particularly when the elastic layer has a polymer having a unit derived from ethylene oxide, a reduction in the discharge intensity within the nip is remarkable.

The present inventors presume, as a result of extensive study of the phenomenon, that the reduction in the discharge intensity within the nip is attributed to the following mechanism.

First, of the electro-conductive surface of the charging member, discharging from oblique surfaces of the protrusions to the electrophotographic photosensitive member plays an important role in the discharge within the nip. However, discharged products and the like adhere to the oblique surfaces of the protrusions during formation of the electrophotographic image for a long period of time to make oblique surfaces of the protrusions insulating. As a result, the discharging from the oblique surfaces of the protrusions is difficult. As a result, the discharge intensity within the nip will reduce over time.

Secondly, it is thought that the reduction in the discharge intensity within the nip is attributed to an increase over time in the electric resistance value at the interface between the elastic layer and the surface layer. Particularly in a low temperature and low humidity environment to a normal temperature and normal humidity environment, the discharge intensity within the nip remarkably reduced. This is probably because the ionic conductivity of the polymer having a unit derived from ethylene oxide, which is used as the elastic layer, reduces over time. Moreover, this is also probably because an ionic substance exhibiting ionic conductivity deteriorates over time or is localized in the elastic layer over time. As a result, the electric resistance value at the interface between the elastic layer and the surface layer will increase to produce a great electrical barrier at the interface between the elastic layer and the surface layer, resulting in an insufficient flow of charges fed from the electro-conductive substrate. This is thought to be one of the reasons for the reduction in the discharge intensity within the nip.

Based on these studies, the present inventors studied suppression of the reduction in the discharge intensity within the nip. During the process, the inventors knew that the reduction in the discharge intensity within the nip can be suppressed by a charging member in which at least one particle selected from the group consisting of the graphite particles and the graphitized particles (hereinafter the graphite particles and graphitized particles are referred to as the "graphite particles and the like" in some cases) is contained in the electro-conductive elastic layer including the polymer having a unit derived from ethylene oxide in the state where the particle is exposed from the elastic layer, and the positional relationship between the particle-exposing portion where the graphite particle and the like is exposed and the protrusion of the surface layer is controlled.

The control of the positional relationship means a control such that when the resin particles forming the protrusions of the surface layer are orthographically projected onto the surface of the elastic layer, areas other than the "projected areas of the resin particles" on the surface of the elastic layer overlap the particle-exposing portions where the graphite particles and the like are exposed. Namely, the protrusion of the surface layer is present at a position not overlapping any particle-exposing portion where the graphite particle and the like is exposed in the elastic layer.

According to the observation of the discharging state of the nip portion of the charging member according to the present invention by the present inventors, portions around the protrusions derived from the resin particles were in contact with the electrophotographic photosensitive member, and the discharge within the nip occurred even in the gap between the portions having no protrusion and the electrophotographic photosensitive member. Moreover, even formation of the electrophotographic image for a long period time barely reduced the discharge intensity within the nip, and high charging performance was kept.

The reason is probably as follows. Namely, the graphite particles and the graphitized particles are highly conductive substances containing a carbon atom which forms a layer structure with an SP2 covalent bond, although the details will be described later. In the particle-exposing portions, the highly conductive graphite particles and the like are present while directly contacting the elastic layer and the surface layer. Thereby, the particle-exposing portions can suppress an increase in the electric resistance at the interface described above. Furthermore, the particle-exposing portion is present at the position not overlapping any protrusion of the surface layer, and the particle-exposing portion corresponding to the surface of the charging member (such as a portion 108 in FIG. 3) can produce the discharge within the nip preferentially. Additionally, the graphite particles and the like are located in depressed portions between the protrusions. It is thought that charged products are relatively more difficult to adhere to the depressed portions than to the oblique surfaces of the protrusions even through formation of the electrophotographic image for a long period of time. For these reasons, it is presumed that the charging member according to the present invention barely reduces the discharge intensity within the nip even through formation of the electrophotographic image for a long period of time.

Here, the present inventors knew that the surface including the particle-exposing portions where the graphite particles and the like are exposed needs to be coated with the surface layer in order to stably keep the discharge intensity within the nip and prevent abnormal discharging in the particle-exposing portion corresponding to the surface of the charging member (such as a portion 108 in FIG. 3).

<Electro-Conductive Substrate>

The electro-conductive substrate used in the charging member according to the present invention has conductivity, and has a function of supporting the electro-conductive elastic layer and the like formed thereon. Examples of the material for the electro-conductive substrate can include metals such as iron, copper, stainless steel, aluminum and nickel, and alloys thereof. To give scratch resistance to the surface of the electro-conductive substrate, the surface may be plated provided that the conductivity is not impaired. Furthermore, as the electro-conductive substrate, resin-base substrates whose surface is coated with a metal to make the surface conductive or substrates made of a conductive resin composition can also be used.

<Electro-Conductive Elastic Layer>

In the charging member according to the present invention, the electro-conductive elastic layer is disposed to ensure a sufficient contact nip width between the charging member and the electrophotographic photosensitive member. The elastic layer contains the polymer having a unit derived from ethylene oxide, which gives conductivity suitable for the charging member. The conductivity needed for the elastic layer of the charging member typically indicates a volume resistivity of approximately $10^2 \Omega \cdot cm$ to $10^{10} \Omega \cdot cm$ which is measured under an environment of a temperature of 23° C. and a relative humidity of 50% (hereinafter referred to as a "normal temperature and normal humidity environment").

The volume resistivity of the elastic layer is determined as follows. First, a material composition having the same composition as the material composition of the elastic layer is molded into a sheet having a thickness of 1 mm, and a section having a length of 5 mm, a width of 5 mm, and a thickness of 1 mm is cut out. A metal is deposited onto both surfaces of the section to produce a sample for measurement. A voltage of 200 V is applied to the produced sample for measurement with a microammeter (trade name: ADVANTEST R8340A ULTRA HIGH RESISTANCE METER, made by Advantest Corporation). Then, the current after 30 seconds is measured, and the volume resistivity is calculated from the thickness and the electrode area to be determined.

Moreover, the hardness needed for the elastic layer of the charging member is typically approximately 30° to 70° in terms of microhardness (MD-1 type). The "microhardness (MD-1 type)" is a hardness measured with an ASKER rubber microdurometer MD-1 type (trade name, made by Kobunshi Keiki Co., Ltd.). In the present invention, the hardness is defined as a value when the charging member left under the normal temperature and normal humidity environment for 12 hours or more, and is measured with the microdurometer in a peak hold mode at 10 N.

[Polymer Having Unit Derived from Ethylene Oxide]

Examples of the polymer having a unit derived from ethylene oxide contained in the electro-conductive elastic layer can include: homopolymers of ethylene oxide, copolymers of ethylene oxide and propylene oxide, polyether esters, polyether amides, polyether ester amides, poly(ethylene glycol acrylate), poly(ethylene glycol)methyl ether, block copolymers of poly(ethylene glycol) and polyethylene, block copolymers of poly(ethylene glycol) and poly (propylene glycol), block copolymers of poly(ethylene glycol) and poly(tetramethylene glycol), and epichlorohydrin rubber.

The elastic layer may contain two or more of the polymers. Among these polymers, particularly epichlorohydrin rubber is preferred because it is easy to control the electric resistance value and hardness of the elastic layer. The epichlorohydrin rubber itself has a middle resistance region, specifically has a conductivity of approximately $1.0\times10^{9}\Omega\cdot$cm to $1.0\times10^{5}\Omega\cdot$cm in terms of volume resistivity. For this reason, in formation of an electro-conductive elastic layer, epichlorohydrin rubber can eliminate addition of a conductive agent to the elastic layer or reduce the amount of the conductive agent to be added. This is advantageous in keeping the softness of the elastic layer.

Specific examples of such epichlorohydrin rubber include: epichlorohydrin homopolymers, epichlorohydrin-ethylene oxide copolymers, epichlorohydrin-allylglycidyl ether copolymers, and epichlorohydrin-ethylene oxide-allylglycidyl ether ternary copolymers. Among these, the ternary copolymers are suitable because these exhibit a particularly stable conductivity in a middle resistance region. Moreover, the ternary copolymers can control conductivity and processability by adjusting the degree of polymerization or the composition ratio. Furthermore, preferably the ternary copolymer is a polymer containing 30% by mass or more of the unit derived from ethylene oxide based on the total mass. The elastic layer particularly preferably contains 40% by mass or more of the ternary copolymer based on the total mass. Thereby, the volume resistivity of the elastic layer can fall within the range above stably. The amount of the unit derived from ethylene oxide in the polymer can be calculated by $^{1}$H-NMR and $^{13}$C-NMR.

[Graphite Particles and Graphitized Particles]

In the charging member according to the present invention, the electro-conductive elastic layer contains one or both of the particles selected from the group consisting of graphite particles and graphitized particles. The graphite particles and the graphitized particles are highly conductive substances containing a carbon atom which forms a layer structure with an SP2 covalent bond. Among these, the graphite particles and the graphitized particles have a peak intensity half width of the peak derived from graphite of 1580 cm$^{-1}$ in a Raman spectrum ($\Delta v_{1580}$) of preferably 80 cm$^{-1}$ or less, and more preferably 60 cm$^{-1}$ or less. $\Delta v_{1580}$ is a value functioning as an index indicating a degree of graphitization, expansion of a graphite plane in an SP2 orbital, or an index indicating conductivity attributed to these. At a peak intensity half width within the range above, the graphite particles and the like can readily attain high conductivity, and more easily suppress the reduction in the discharge intensity within the nip.

Furthermore, the graphite particles and the like more can have a graphite (002) plane lattice spacing of 0.3354 nm or more and 0.3365 nm or less. It is known that a perfect graphite particle has the graphite (002) plane lattice spacing of 0.3354 nm. As the value increases from 0.3354 nm, the conductivity of the graphite particles and graphitized particles reduces. Namely, the graphite particles and graphitized particles having a crystal structure having stacked hexagonal network planes have high conductivity because π-electrons are present and move within the hexagonal network as free electrons.

As described above, the graphite particles and the like according to the present invention having the graphite (002) plane lattice spacing within the range above can readily attain high conductivity, and more easily suppress the reduction in the discharge intensity within the nip.

Moreover, the graphite particles and graphitized particles having the graphite plane lattice spacing within the range above develop a crystal structure having stacked hexagonal network planes, and have a flaky form. In this case, the graphite particles and the graphitized particles readily cleave in a polishing step described in detail later which is a step of exposing the graphite particles and the graphitized particles. For this reason, the graphite particles and the graphitized particles can more stably form the particle-exposing portions without dropping off from the elastic layer in the step. The term "cleavage" means that the graphite particles and the graphitized particles are peeled in the form of layers in a crystal plane. By using the graphite particles or graphitized particles having high cleaving properties, exposed graphite particles and/or graphitized particles can be present on the surface of the elastic layer after the polishing step. On the other hand if the graphite particles and the graphitized particles have no cleaving properties or low cleaving properties, the particles themselves drop off by polishing, and exposed particles are difficult to be present on the surface of the elastic layer.

Examples of the graphite particles according to the present invention include natural graphites, and examples of the graphitized particles can include artificial graphites. The natural graphites as the graphite particle have high crystallinity, and can have the graphite (002) plane lattice spacing of 0.3354 nm to 0.3365 nm. The particle sizes and shapes of the graphite particles can be adjusted by crushing and classification.

The artificial graphites as the graphitized particles can be produced by calcining a graphitized particle precursor. The precursor and the calcining conditions can be selected to control the shape and conductivity of the graphitized particles to be produced. Namely, the graphite (002) plane lattice spacing can be adjusted by the calcining conditions. The shapes of the graphitized particles to be produced are approximately determined depending on the shape of the precursor. Examples of usable precursors can include bulk mesophase pitches, mesocarbon microbeads, phenol resins and phenol resins coated with a mesophase, and coke coated with pitch. The graphitized particles are particularly preferably products produced by calcining bulk mesophase pitches and products produced by calcining mesocarbon microbeads. The conductivity of the graphitized particles to be produced varies according to the calcining conditions. Usually, the conductivity is higher as the temperature is higher and the calcining time is longer. Furthermore, the conductivity varies depending on the chemical bond structure of the precursor. The types of the precursors lead to differences in changes in crystallinity such as poor graphitization and easy graphitization. For this reason, the same conductivity is not always obtained even if these precursors are calcined on the same conditions. A specific method of producing these graphitized particles will be described below, but the graphitized particles will not be limited to those produced by these production methods.

[Graphitized Particles Produced by Calcining Coke Coated with Pitch]

A pitch is added to coke, and the mixture is molded and calcined to produce a graphitized particle produced by calcining coke coated with pitch. For the coke, a residue oil in petroleum distillation or coal tar pitch is heated at a temperature of approximately 500° C. to produce crude coke, and the crude coke is further calcined at a temperature of 1200° C. or more and 1400° C. or less. The calcined coke can be used. For the pitch, a pitch produced as a residue through distillation of coal tar can be used.

In the method of producing a graphitized particle using these raw materials, first, the coke is pulverized, and mixed with the pitch. Subsequently, the mixture is kneaded under heating at approximately 150° C., and is molded with a molding machine. The molded article is heated at a temperature of 700° C. or more and 1000° C. or less to give thermal stability. Next, the article is further heated at a temperature of 2600° C. or more and 3000° C. or less to produce a desired graphitized particle. During the heating, the molded article can be covered with a coke for packing to prevent oxidation.

[Graphitized Particles Produced by Calcining Bulk Mesophase Pitch]

The bulk mesophase pitch can be produced: for example, a β-resin is extracted from a coal tar pitch or the like by solvent fractionation, and the β-resin is subjected to hydrogenation and densification. After the densification, a coal tar pitch is pulverized, and a solvent soluble content is removed with benzene or toluene, for example. Thereby, the bulk mesophase pitch can also be produced. The bulk mesophase pitch preferably has a quinoline soluble content of 95% by mass or more. The bulk mesophase pitch having a quinoline soluble content of 95% by mass or more is more preferable because the inside of the particles is readily liquid phase carbonized to control the shape of the particle to be substantially spherical.

In the method of producing a graphitized particle using a mesophase pitch, first, the bulk mesophase pitch is pulverized, and heated in the air at a temperature of 200° C. or more and 350° C. or less to be oxidized lightly. This oxidation produces an unfusable surface of the bulk mesophase pitch particle. The surface of the bulk mesophase pitch particle is prevented from melting and fusing during heating in the subsequent step. The oxidized bulk mesophase pitch particle can have an oxygen content of 5% by mass or more and 15% by mass or less. The oxidized bulk mesophase pitch particle having an oxygen content of 5% by mass or more can suppress an increase in fusing of the particles during the heating. Moreover, the oxidized bulk mesophase pitch particle having an oxygen content of 15% by mass or less can suppress oxidation of the inside of the particles, which leads to a graphitization of the particles having crushed shapes, and can produce a spherical particle. The oxidized bulk mesophase pitch particles are heated under an atmosphere of an inert gas such as nitrogen and argon at a temperature of 1000° C. or more and 3500° C. or less to produce a desired graphitized particle.

[Graphitized Particles Produced by Calcining Mesocarbon Microbeads]

Examples of a method of producing mesocarbon microbeads can include the following method. First, a coal heavy oil or petroleum heavy oil is heated at a temperature of 300° C. or more and 500° C. or less, and polycondensed to produce crude mesocarbon microbeads. Then, the reaction product is filtered, left to stand sedimented, and centrifuged to separate mesocarbon microbeads. The mesocarbon microbeads are washed with a solvent such as benzene, toluene, and xylene, and are dried.

In the method of producing a graphite particle using the mesocarbon microbeads, first, to prevent aggregation of the graphitized particles and attain a uniform grain size of the particle, the dried mesocarbon microbeads can be primarily dispersed mechanically by a force so as not to break the microbeads. The primarily dispersed mesocarbon microbeads are primarily heated under an inert gas atmosphere at a temperature of 200° C. or more and 1500° C. or less to form carbides thereof. Preferably, these carbides are mechanically dispersed (secondarily dispersed) by a force so as not to break the carbides to prevent aggregation of the graphitized particles and attain a uniform grain size. The secondarily dispersed carbides are secondarily heated under an inert atmosphere at a temperature of 1000° C. or more and 3500° C. or less to produce a desired graphitized particle.

The content of the graphite particle and/or the graphitized particle in the elastic layer according to the present invention is preferably 1 part by mass to 100 parts by mass, and more preferably 5 parts by mass to 50 parts by mass based on 100 parts by mass of the polymer having a unit derived from ethylene oxide. At a content within this range, the hardness needed for the elastic layer can be readily attained, and the positional relationship with the resin particles contained in the surface layer described later can be readily controlled.

Moreover, the graphite particle or the graphitized particle has a volume average particle size of preferably 1 μm or more and 150 μm or less, and more preferably 2 μm or more and 100 μm or less. At a volume average particle size within this range, the positional relationship with the resin particles contained in the surface layer can be readily controlled.

Furthermore, the graphite particle or the graphitized particle has a ratio of long diameter/short diameter of preferably 1 or more and 5 or less, and more preferably 1.2 or more and 2.5 or less. At a ratio within this range, the graphite particles and graphitized particles can more stably form the particle-exposing portions without dropping off from the elastic layer in the polishing step described above.

[Other Materials]

In the charging member according to the present invention, the electro-conductive elastic layer may further contain "other polymers." Examples of other polymers include typical rubbers such as: EPM (ethylene-propylene rubber), EPDM (ethylene-propylene-diene copolymer), NBR (acrylonitrile-butadiene copolymerized rubber), chloroprene rubber, natural rubber, isoprene rubber, butadiene rubber, styrene-butadiene rubber, urethane rubber, silicone rubber, SBS (styren-butadien-styrene block copolymer), and SEBS (styren-ethylene butylen-styrene block copolymer).

To adjust volume resistivity, the elastic layer can contain an ionic conductive agent or an electron conductive agent properly. If the elastic layer includes the polymer having a unit derived from ethylene oxide, the volume resistivity can be adjusted with an ionic conductive agent. Examples of the ionic conductive agent include: inorganic ion substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfate; amphoteric ion surfactants such as lauryl betaine, stearyl betaine, and dimethylalkyllauryl betaine; quaternary ammonium salts such as tetraethylammonium perchlorate, tetrabutylammonium perchlorate, and trimethyloctadecylammonium perchlorate; and organic acid lithium salts such as lithium trifluoromethanesulfonate. These can be used alone or in combination. Among these, ammonium salts are more preferably used. Thereby, the volume resistivity of the elastic layer can be more easily controlled.

Moreover, to adjust hardness and the like, the elastic layer may contain additives such as softening oil and a plasticizer.

[Method of Forming Elastic Layer]

A method of forming the electro-conductive elastic layer is exemplified below. First, a coating layer including the polymer having a unit derived from ethylene oxide and at least one particle selected from the group consisting of the graphite particles and the graphitized particles and dispersed in the polymer (hereinafter also referred to as a "preparative coating layer" in some cases) is prepared on an electro-conductive substrate. Subsequently, the surface is polished to expose the graphite particles and the like contained in the surface layer to the surface of the elastic layer.

Examples of the method of forming the preparative coating layer include an electrostatic spray coating method, a dipping coating method, a roll coating method, a method of bonding or coating a sheet- or tube-like layer formed to have a predetermined layer thickness, and a method of disposing a conductive resin composition inside of a mold so as to correspond to the outer periphery of an electro-conductive substrate, and curing the composition. Because the polymer is usually rubber, particularly preferably, the electro-conductive substrate and the unvulcanized rubber composition are integrally extruded with an extruder including a crosshead. The crosshead is an extrusion metal mold used for producing coating layers for electric wires and wires. The crosshead is disposed on the tip of a cylinder of the extruder.

After drying, curing, or crosslinking, the surface of the preparative coating layer is polished to expose the graphite particles and the like to the surface of the elastic layer. For the polishing method, a cylinder polishing method or tape polishing can be used. Examples of cylinder polishing machines can include traverse mode NC cylinder polishing machines and plunge cutting mode NC cylinder polishing machines. Considering the efficiency in the polishing step, the cylinder polishing method is more preferably used. Among these cylinder polishing methods, the plunge cutting mode is still more preferably because the surface of the preparative coating layer can be polished across the longitudinal direction thereof to reduce the polishing time.

Preferable polishing conditions for the preparative coating layer will be shown below as one example where the plunge cutting mode cylinder polishing machine is used. The number of rotations of the cylinder polishing grinding wheel is preferably 500 rpm or more and 4000 rpm or less, and more preferably 1000 rpm or more. The intrusion rate to the preparative coating layer is preferably 5 mm/sec or more and 30 mm/sec or less, and more preferably 10 mm/sec or more. At this time, the rate may be sequentially decreased as the grinding wheel intrudes to the preparative coating layer. The intrusion step may have a running-in step at the end thereof. The spark-out step (polishing step at an intrusion rate of 0 mm/min) is preferably set to be 10 seconds or less. If the member having the preparative coating layer formed thereon can rotate (has the form of a roller, for example), the number of rotations is set to be preferably 50 rpm or more and 500 rpm or less, and more preferably 200 rpm or more.

The graphite particles and/or the graphitized particles exposed to the interface may be particles of a single substance or aggregates of the particles. The particle preferably has a volume average particle size of 2 μm or more and 200 μm or less. Particularly the volume average particle size is more preferably 3 μm or more and 100 μm or less. At a volume average particle size within this range, a reduction in the discharge intensity within the nip can be more easily suppressed.

For a method for controlling the particle size of the graphite particles and/or the graphitized particles within this range, a method for controlling the primary particle size(s) of the graphite particles and/or the graphitized particles to be contained within this range may be used. Alternatively, the particles may be crushed or dispersed, and controlled to have the particle size within the range above. However, the particle size within the range above is distributed in a very narrow range, a step of dispersing the particles in the polymer is necessary. For a method for dispersion, any known method can be used. Because the polymer is usually rubber as described above, the particles can be dispersed with a rubber kneading apparatus. Examples of the kneading apparatus include a sealed type mixer and a two-roll mill.

A particularly preferable method for controlling dispersion of the particles in a rubber polymer is a two-roll mill kneader. The particle size of the graphite particles and/or the graphitized particles can be controlled to be closer to the primary particle size thereof at an interval of the two-roll mill of 2.0 mm or less and a kneading temperature of 30° C. or less.

The content of the graphite particles and/or the graphitized particles in the elastic layer is preferably 2 parts by mass or more and 100 parts by mass or less, and more preferably 5 parts by mass or more and 50 parts by mass or less based on 100 parts by mass of the polymer. As described later, at a content within this range, the positional relationship with the resin particles to be contained in the surface layer can be more easily controlled.

<Electro-Conductive Surface Layer>

[Binder Resin]

Examples of the binder resin used for the electro-conductive surface layer according to the present invention include known rubbers or resins. Examples of rubber can include natural rubber, vulcanized natural rubber, and synthetic rubber.

Examples of synthetic rubber include: ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorohydrin rubber, and fluorocarbon rubber.

As the resin, thermosetting resins and thermoplastic resins and the like can be used, for example. Among these, fluorinated resin, polyamide resin, acrylic resin, polyurethane resin, acrylic urethane resin, silicone resin, and butyral resin are more preferred.

These may be used singly or in combinations of two or more. Further, monomers that are raw materials for these resins may be copolymerized and used as copolymers.

Among these, the resins listed above can be used as the binder resin. This is because these resins can control adhesion and friction properties to the electrophotographic photosensitive member more easily.

The electro-conductive surface layer may be formed by adding a crosslinking agent and the like to a prepolymer as a raw material of a binder resin, and curing or crosslinking the prepolymer. Herein, the mixture containing the crosslinking agent and the like will also be referred to as the "binder resin".

[Resin Particle]

Examples of resin particles contained in the electro-conductive surface layer according to the present invention include particles formed of high molecular compounds below: resins such as acrylic resin, styrene resin, polyamide resin, silicone resin, vinyl chloride resin, vinylidene chloride resin, acrylonitrile resin, fluorinated resin, phenol resin, polyester resin, melamine resin, urethane resin, olefin resin, epoxy resin, copolymers, modified products, and derivatives thereof; and thermoplastic elastomers such as ethylene-propylene-diene copolymer (EPDM), styrene-butadiene copolymerization rubber (SBR), silicone rubber, urethane rubber, isoprene rubber (IR), butyl rubber, chloroprene rubber (CR), polyolefin thermoplastic elastomers, urethane thermoplastic elastomers, polystyrene thermoplastic elastomers, fluorocarbon rubber thermoplastic elastomers, polyester thermoplastic elastomers, polyamide thermoplastic elastomers, polybutadiene thermoplastic elastomers, ethylene vinyl acetate thermoplastic elastomers, polyvinyl chloride thermoplastic elastomers, and chlorinated polyethylene thermoplastic elastomers. These resin particles are easy to disperse in the binder resin. Moreover, the resin particles formed of the following resins can be used because the gap between the charging member and the electrophotographic photosensitive member for producing the discharge within the nip is readily kept under all the environments in formation of the protrusions on the surface of the charging member (surface of the electro-conductive surface layer): acrylic resins, styrene resins, polyamide resins, silicone resins, vinyl chloride resins, vinylidene chloride resins, acrylonitrile resins, fluorinated resins, urethane resins, and epoxy resins.

The resin particles can be used singly or in combinations of two or more, and may be subject to a surface treatment, modification, introduction of a functional group or a molecule chain, coating, and the like.

The content of the resin particle in the surface layer is preferably 2 parts by mass or more and 100 parts by mass or less, and more preferably 5 parts by mass or more and 80 parts by mass or less based on 100 parts by mass of the binder resin. At a content within this range, the discharge within the nip can be produced more stably.

The volume average particle size of the resin particle is particularly preferably 15 μm or more and 60 μm or less. At a volume average particle size within this range, the discharge within the nip can be produced more stably.

The resin particles contained in the electro-conductive surface layer according to the present invention more preferably each have a plurality of pores having air-containing regions inside thereof. As described later, this facilitates control of the positional relationship between the particle-exposing portions where the graphite particles and/or the graphitized particles are exposed in the elastic layer and the resin particles in the surface layer. At the same time, the gap can be readily formed in the nip between the charging member and the electrophotographic photosensitive member, resulting in stable discharge within the nip.

For the resin particles each having a plurality of pores having air-containing regions inside thereof, a "multi-hollow particle" and a "porous particle" shown below can be used. In the present invention, the "multi-hollow particle" is defined as a particle having a plurality of pores having air-containing regions inside thereof and not penetrating through the surface of the resin particle. On the other hand, in the present invention, the "porous particle" is defined as a particle having a plurality of pores having air-containing regions inside thereof and not penetrating through the surface of the resin particle, and having a number of micropores penetrating through the surface of the resin particle in portions other than the pores.

Hereinafter, the porous particle and the multi-hollow particle according to the present invention will be described in detail.

[Porous Particle]

Examples of the material for the porous particle can include acrylic resins, styrene resins, acrylonitrile resins, vinylidene chloride resins, and vinyl chloride resins. These resins can be used alone or in combination of two or more. Further, monomers that are raw materials for these resins may be copolymerized and used as copolymers. These resins may be used as the main component, and other known resins may be contained when necessary.

The porous particle according to the present invention can be produced by a known production method such as a suspension polymerization method, an interface polymerization method, an interface precipitation method, a liquid drying method, and a method in which a solute or solvent for reducing the solubility of a resin is added to a resin solution to precipitate the resin. For example, in the suspension polymerization method, in the presence of a crosslinkable monomer, a porosifying agent is dissolved in a polymerizable monomer to prepare an oily mixed solution. Using the oily mixed solution, aqueous suspension polymerization is performed in an aqueous medium containing a surfactant and a dispersion stabilizer. After completion of the polymerization, water and the porosifying agent can be removed by washing and drying to obtain a resin particle. A compound having a reactive group reactive with a functional group in the polymerizable monomer, an organic filler or the like can be added. To form pores inside of the porous particle, the polymerization can be performed in the presence of the crosslinkable monomer.

Examples of the polymerizable monomer include: styrene monomers such as styrene, p-methyl styrene, and p-tert-butyl styrene; and (meth)acrylic acid ester monomers such as methyl acrylate, ethyl acrylate, propyl acrylate, butyl acrylate, 2-ethylhexyl acrylate, lauryl acrylate, methyl methacrylate, ethyl methacrylate, propyl methacrylate, butyl methacrylate, isobutyl methacrylate, tert-butyl methacrylate, benzyl methacrylate, phenyl methacrylate, isobornyl methacrylate, cyclohexyl methacrylate, glycidyl methacrylate, hydrofurfuryl methacrylate, and lauryl methacrylate. These polymerizable monomers are used alone, optionally in combination of two or more. In the present invention, the term "(meth)acrylic" is a concept including both acrylic and methacrylic.

The crosslinkable monomer is not particularly limited as long as the crosslinkable monomer has a plurality of vinyl groups, and examples thereof can include: (meth)acrylic acid ester monomers such as ethylene glycol di(meth)acrylate, diethylene glycol di(meth)acrylate, triethylene glycol di(meth)acrylate, decaethylene glycol di(meth)acrylate, pentadecaethylene glycol di(meth)acrylate, pentacontahectaethylene glycol di(meth)acrylate, 1,3-butylene glycol di(meth)acrylate, 1,4-butanediol di(meth)acrylate, 1,6-hexanediol di(meth)acrylate, glycerin di(meth)acrylate, allyl methacrylate, trimethylolpropane tri(meth)acrylate, pentaerythritol tetra(meth)acrylate, phthalic acid diethylene glycol di(meth)acrylate, caprolactone-modified dipentaerythritol hexa(meth)acrylate, caprolactone-modified hydroxy pivalic acid ester neopentyl glycol diacrylate, polyester acrylate, and urethane acrylate; divinylbenzene, divinylnaphthalene, and derivatives thereof. These can be used alone or in combination of two or more.

The crosslinkable monomer can be used such that the content in the monomer is 5% by mass or more and 90% by mass or less. At a content within this range, the pores can be surely formed inside of the porous particle.

As the porosifying agent, a non-polymerizable solvent, a mixture of a linear polymer dissolved in a mixture of polymerizable monomers and a non-polymerizable solvent, and a cellulose resin can be used. Examples of the non-polymerizable solvent can include: toluene, benzene, ethyl acetate, butyl acetate, normal hexane, normal octane, and normal dodecane. The cellulose resin is not particularly limited, and examples thereof can include ethyl cellulose. These porosifying agents can be used alone or in combination of two or more. The amount of the porosifying agent to be added can be properly set according to the purpose of use. The porosifying agent can be used in the range of 20 parts by mass to 90 parts by mass in 100 parts by mass of an oil phase including the polymerizable monomer, the crosslinkable monomer, and the porosifying agent. At the amount within this range, the porous particle is prevented from being fragile, and a gap is easily formed in the nip between the charging member and the electrophotographic photosensitive member.

The polymerization initiator is not particularly limited, and those soluble in the polymerizable monomer can be used. Known peroxide initiators and azo initiators can be used, and examples thereof can include: 2,2'-azobisisobutyronitrile, 1,1'-azobiscyclohexane-1-carbonitrile, 2,2'-azobis-4-methoxy-2,4-dimethylvaleronitrile, and 2,2'-azobis-2,4-dimethylvaleronitrile.

Examples of the surfactant can include: anionic surfactants such as sodium lauryl sulfate, polyoxyethylene (polymerization degree: 1 to 100) sodium lauryl sulfate, and polyoxyethylene (polymerization degree: 1 to 100) lauryl sulfate triethanolamine; cationic surfactants such as stearyl trimethyl ammonium chloride, stearic acid diethylaminoethylamide lactic acid salt, dilaurylamine hydrochloride, and oleylamine lactic acid salt; nonionic surfactants such as adipic acid diethanol amine condensates, lauryldimethylamine oxides, glycerin monostearate, sorbitan monolaurate, and stearic acid diethylaminoethylamide lactic acid salt; amphoteric surfactants such as palm oil fatty acid amide propyl dimethyl amino acetic acid betaine, lauryl hydroxysulfobetaine, and sodium β-laurylaminopropionate; and high molecular dispersants such as polyvinyl alcohol, starch, and carboxymethylcellulose.

Examples of the dispersion stabilizer can include: organic fine particles such as polystyrene fine particles, polymethyl methacrylate fine particles, polyacrylic acid fine particles, and polyepoxide fine particles; silica such as colloidal silica; calcium carbonate, calcium phosphate, aluminum hydroxide, barium carbonate, and magnesium hydroxide.

Among the polymerization methods, particularly a specific example of the suspension polymerization method will be described below. The suspension polymerization can be performed under a sealing condition using a pressure-resistant container. Prior to the polymerization, the raw material component may be suspended with a dispersing machine or the like, the suspension may be placed in a pressure-resistant container and suspension polymerized; or the reaction solution may be suspended in a pressure-resistant container. The polymerization temperature is more preferably 50° C. to 120° C. The polymerization may be performed under atmospheric pressure. To prevent the porosifying agent from becoming gaseous, the polymerization can be performed under increased pressure (under a pressure atmospheric pressure plus 0.1 to 1 MPa). After the polymerization is completed, solid liquid separation, washing and the like may be performed by centrifugation, filtering or the like. After solid liquid separation and washing, the obtained product may be dried or crushed at a temperature equal to or less than the softening temperature of the resin that forms the resin particle. Drying and crushing can be performed by a known method, and an air dryer, a fair wind dryer, a Nauta Mixer or the like can be used. Drying and crushing can be performed at the same time with a crusher dryer or the like. The surfactant and the dispersion stabilizer can be removed by repeating washing and filtering or the like after production.

The particle diameter of the resin particle can be adjusted according to the mixing conditions for the oily mixed solution including the polymerizable monomer and the porosifying agent and the aqueous medium containing the surfactant and the dispersion stabilizer, the amount of the dispersion stabilizer or the like to be added, and the stirring and dispersing conditions or the like. If the amount of the dispersion stabilizer to be added is increased, the average particle size can be decreased. In the stirring and dispersing conditions, if the stirring rate is increased, the average particle size of the porous particle can be decreased. The porous particle according to the present invention preferably has a volume average particle size in the range of 5 to 60 μm. Furthermore, the volume average particle size is more preferably in the range of 10 to 50 μm. At a volume average particle size within this range, the discharge within the nip can be generated more stably.

Moreover, the micropores diameter and the inner pore diameter of the porous particle, and the proportion of the air-containing region can be adjusted by the amount of the crosslinkable monomer to be added, the type and amount of the porosifying agent to be added, and the like. The pore diameter can be decreased by increasing the amount of the crosslinkable monomer to be added. Moreover, if the micropores diameter is further increased, such an increase can be attained with a cellulose resin as the porosifying agent.

The micropores diameter of the porous particle is preferably 10 to 500 nm, and within the range of 20% or less based on the average particle size of the resin particle. Furthermore, the micropores diameter is more preferably 20 to 200 nm, and within the range of 10% or less based on the average particle size of the resin particle. A micropores diameter within this range facilitates control of the positional relationship between the particle-exposing portions where the graphite particles and/or the graphitized particles are exposed in the elastic layer and the resin particles in the surface layer. At the same time, the gap can be readily formed in the nip between the charging member and the electrophotographic photosensitive member, resulting in stable discharge within the nip.

[Multi-Hollow Particle]

Examples of the material for the multi-hollow particle can include the resins exemplified as the material for the porous particles. These resins can be used alone or in combination.

Furthermore, a monomer as a raw material for these resins may be copolymerized, and the produced copolymer may be used. The material for the multi-hollow particle may contain these resins as the main component and an additional known resin when necessary.

The multi-hollow particle according to the present invention can be produced by a known production method such as a suspension polymerization method, an interface polymerization method, an interface precipitation method, and a liquid drying method.

(a) Preparation of Multi-Hollow Particle by Suspension Polymerization Method

In preparation of the multi-hollow particle by the suspension polymerization method, first, an oily mixed solution including a hydrophobic polymerizable monomer, a hydrophilic polymerizable monomer, and a polymerization initiator is prepared in the presence of a crosslinking agent. The oily mixed solution is aqueous suspension-polymerized in an aqueous medium solution containing a dispersion stabilizer. After the polymerization, the reaction product is washed, and dried to produce a multi-hollow particle.

In this method, water invades into droplets of the oily mixed solution and holds these droplets during mixing of the oily mixed solution with the aqueous medium solution. Thereby, a multi-hollow particle having hollow portions formed therein is produced. Moreover, the multi-hollow particle can be produced by another method: water is added to the oily mixed solution in advance to prepare an emulsified mixed solution; the emulsified mixed solution is dispersed in the aqueous medium solution; then, the dispersion is suspension polymerized. In this case, the content of the hydrophobic monomer can be adjusted to be 70% by mass to 99.5% by mass and the content of the hydrophilic monomer is adjusted to be 0.5% by mass to 30% by mass based on the total of the hydrophobic monomer and the hydrophilic monomer. This facilitates production of the multi-hollow particle.

Examples of the hydrophobic monomer include (meth) acrylic acid ester monomers; polyfunctional (meth)acrylic acid ester monomers; styrene monomers such as styrene, p-methylstyrene, and α-methylstyrene; and vinyl acetate. Among these, from the viewpoint of pyrolysis properties, (meth)acrylic acid ester monomers are preferable, and methacrylic acid ester monomers are more preferable. Examples of the (meth)acrylic acid ester monomers include: methyl (meth)acrylate, ethyl (meth)acrylate, propyl (meth)acrylate, n-butyl (meth)acrylate, isobutyl (meth)acrylate, hexyl (meth)acrylate, octyl (meth)acrylate, 2-ethylhexyl (meth) acrylate, and lauryl (meth)acrylate. These hydrophobic monomers may be used in combination.

Examples of the hydrophilic monomers include hydroxyl group-terminated polyalkylene glycol mono(meth)acrylates such as polyethylene glycol mono(meth)acrylate, polypropylene glycol mono(meth)acrylate, poly(ethylene glycol-propylene glycol) mono(meth)acrylate, polyethylene glycol-polypropylene glycol mono(meth)acrylate, poly(meth) acrylate, poly(propylene glycol-tetramethylene glycol) mono(meth)acrylate, and propylene glycol polybutylene glycol mono(meth)acrylate. These may be used in combination.

For the crosslinkable monomer, the same monomers as those exemplified in the porous particle can be used. Preferably, the content of the crosslinkable monomer is adjusted to be 0.5% by mass to 60% by mass based on the total of the hydrophobic monomer and the hydrophilic monomer.

For the polymerization initiator, the surfactant, and the dispersion stabilizer, the same compounds as those exemplified in the porous particle can be used. These polymerization initiators, dispersion stabilizers, and surfactants each may be used alone or in combination. The proportion of the polymerization initiator to be used is preferably 0.01 parts by mass to 2 parts by mass based on 100 parts by mass of the monomer. The proportion of the dispersion stabilizer to be used is preferably 0.5 parts by mass to 30 parts by mass based on 100 parts by mass of the monomer. The proportion of the surfactant is preferably 0.001 parts by mass to 0.3 parts by mass based on 100 parts by mass of water.

The oily mixed solution is mixed with an aqueous medium. While these are being stirred, the temperature is raised to perform a polymerization reaction. Preferably, the polymerization temperature is 40° C. to 90° C., and the polymerization time is approximately 1 hour to 10 hours. At this time, the mixing conditions and stirring conditions for the monomer and water can be controlled to determine the average particle size of the multi-hollow particle properly.

(b) Production Method Using Cellulose Resin

In this method, a cellulose resin is dissolved in a monomer mixture including at least styrene as the monomer and a polyfunctional polymerizable monomer to prepare a dissolution solution.

Examples of the polyfunctional polymerizable monomer include aromatic divinyl compounds, acrylic acid esters of polyhydric alcohols, and methacrylic acid esters of polyhydric alcohols. These can be used alone or in combination. Specifically, examples of the aromatic divinyl compounds include divinylbenzene and divinyl naphthalene. Examples of (meth)acrylic acid esters of polyhydric alcohols include: ethylene glycol di(meth)acrylate, 1,3-butylene glycol di(meth)acrylate, polyethylene glycol di(meth)acrylate, and trimethylolpropane trimethacrylate. The term (meth)acrylate means acrylate or methacrylate. Among these, divinylbenzene and ethylene glycol dimethacrylate can be used to form good pores.

The content of the polyfunctional polymerizable monomer is preferably 5 mass to 100 parts by mass, and more preferably 5 parts by mass to 50 parts by mass based on 100 parts by mass of styrene. At a content within this range, preferable physical properties of the multi-hollow particle described later are readily attained.

Moreover, "other monomers" copolymerizable with the polyfunctional polymerizable monomer and styrene may be added in the range in which the properties of the hollow particle are not impaired. Examples of the other monomers can include the same polymerizable monomers as those exemplified in the porous particle.

Examples of the cellulose resin used in the method include: cellulose acetate, carboxymethyl cellulose, hydroxyethyl cellulose, hydroxypropyl cellulose, methyl cellulose, ethyl cellulose, ethylhydroxyethyl cellulose, and carboxymethylethyl cellulose. Among these, ethyl cellulose can be used to form good pores in the multi-hollow particle.

Ethyl cellulose is typically an ethyl cellulose ether prepared by a reaction of ethyl chloride with alkali cellulose. Commercially available ethyl celluloses usually have a content of an ethoxyl group of 44 to 50% by mass. Among these, ethyl celluloses having a viscosity (viscosity when 5% by mass of ethyl cellulose is dissolved in a mixed solution at toluene:ethanol=80:20 as the mass ratio) of 10 to 200 cP can be suitably used. More preferably, those having a viscosity of 20 to 100 cP are suitably used. At a viscosity within this range, the particle size of the multi-hollow particle can be easily controlled. The viscosity is a value measured with an Ubbelohde viscometer (capillary viscometer) at a temperature of 25° C.±0.5° C. according to JIS 28803.

The proportion of the cellulose resin to be used is 0.5 parts by mass to 5 parts by mass, and preferably 1 part by mass to 3 parts by mass based on 100 parts by mass of the monomer mixture of styrene and the polyfunctional polymerizable monomer. At a proportion within this range, the particle size of the multi-hollow particle can be easily controlled.

For the polymerization initiator, the same compounds as those exemplified in production of the porous particle can be used. Among these, 2,2'-azobisisobutyronitrile and 2,2'-azobis(2,4-dimethylvaleronitrile) are particularly preferable. The proportion of the polymerization initiator to be used is preferably 0.01 parts by mass to 10 parts by mass, and particularly preferably 0.1 parts by mass to 5.0 parts by mass based on 100 parts by mass of the monomer mixture.

Moreover, for the dispersion stabilizer and the surfactant, the same compounds as those exemplified in production of the porous particle can be used. The type and amount of the dispersion stabilizer or surfactant to be used is properly selected or combined in consideration of the particle size of the multi-hollow particle to be produced or the dispersion stability of the dissolution solution during polymerization, for example. As one example, the amount of the dispersion stabilizer to be used is preferably 0.5 parts by mass to 20 parts by mass based on 100 parts by mass of the monomer mixture, and the amount of the surfactant to be used is preferably 0.001 parts by mass to 0.1 parts by mass based on 100 parts by mass of the aqueous medium.

Moreover, to suppress polymerization of the monomer in the aqueous medium, approximately 0.01 parts by mass to 1 part by mass water-soluble polymerization inhibitor may be added to 100 parts by mass of the aqueous medium. The water-soluble polymerization inhibitor can be used without limitation, and known inhibitors can be used. Examples thereof can include nitrous acid salts and hydroquinone.

The droplets including the monomer mixture are dispersed in an aqueous medium, and the dispersion is heated to perform a polymerization reaction. The polymerization temperature is usually 30° C. to 100° C., and preferably 40° C. to 80° C. Moreover, the time to keep the polymerization temperature is preferably approximately 0.1 hours to 10 hours.

After the polymerization is completed, if desired, the dispersion stabilizer may be dissolved in hydrochloric acid or the like, and the multi-hollow particle may be separated from the dispersion medium by an operation such as suction filtration, centrifugation, and centrifugal filtration. The multi-hollow particle may be further washed with ion exchange water or the like. Subsequently, through drying, crushing, classification, and the like, a multi-hollow particle can be produced.

The pore contained in the multi-hollow particle preferably has a diameter of 0.05 μm or more and 15 μm or less. More preferably, the pore diameter is 0.1 μm or more and 10 μm or less. At a pore diameter within this range, more stable discharge within the nip can be produced.

The proportion of the air-containing region inside of the multi-hollow particle can be 10% or more and 50% or less where the total volume including the air-containing region of the multi-hollow particle is 100%. At a proportion within this range, more stable discharge within the nip can be produced.

[Conductive Agent]

The electro-conductive surface layer according to the present invention contains a known conductive agent to exhibit conductivity. Examples of the conductive agent can include the ionic conductive agents described above and the electron conductive agents described later (hereinafter referred to as "conductive fine particles" in some cases).

Examples of the conductive fine particle include: metallic fine particles and fibers of aluminum, palladium, iron, copper, and silver; metal oxides such as titanium oxide, tin oxide, and zinc oxide; composite particles obtained by surface treating the surfaces of the metallic fine particles, fibers, and metal oxides by electrolysis processing, spray coating, or mixing and shaking; and carbon black and carbon fine particles.

Examples of carbon black can include black furnace black, thermal black, acetylene black, and ketjen black. Examples of furnace black include: SAF-HS, SAF, ISAF-HS, ISAF, ISAF-LS, I-ISAF-HS, HAF-HS, HAF, HAF-LS, T-HS, T-NS, MAF, FEF, GPF, SRF—HS-HM, SRF-LM, ECF, and FEF-HS. Examples of thermal black include FT and MT. Examples of carbon fine particles can include PAN(polyacrylonitrile) carbon particles and pitch carbon particles.

Moreover, these ionic conductive agents and conductive fine particles can be used alone or in combination.

The content of the conductive agent in the surface layer is in the range of 2 to 200 parts by mass, and preferably 5 to 100 parts by mass base on 100 parts by mass of the binder resin.

The conductive fine particle may have a surface treated. As the surface treatment agent, organic silicon compounds such as alkoxysilane, fluoroalkylsilane, and polysiloxane; a variety of coupling agents such as silane coupling agents, titanate coupling agents, aluminate coupling agents, and zirconate coupling agents; oligomers or high molecular compounds can be used. These may be used singly or in combination of two or more. The surface treatment agent is preferably organic silicon compounds such as alkoxysilane and polysiloxane, and a variety of coupling agents such as silane coupling agents, titanate coupling agents, aluminate coupling agents, or zirconate coupling agents, and more preferably organic silicon compounds.

[Method of Forming Surface Layer]

Examples of the method of forming the surface layer can include the following method. First, an electro-conductive elastic layer having the particle-exposing portions where one or both of the particles selected from the group consisting of the graphite particles and the graphitized particles is exposed on the surface thereof is formed on the electro-conductive substrate by the method described above. Next, the surface of the elastic layer is coated with a layer of a conductive resin composition, and is dried, cured, or crosslinked. Examples of the coating method include an electrostatic spray coating method, a dipping coating method, a roll coating method, a method of bonding or coating a sheet- or tube-like layer formed to have a predetermined layer thickness, and a method of disposing a conductive resin composition inside of a mold so as to correspond to the outer periphery of an elastic layer, and curing the composition. Among these, the methods of forming the surface layer by electrostatic spray coating, dipping coating, roll coating, and the like can be used to control the positional relationship between the resin particles in the surface layer and the graphite particles and/or the graphitized particles exposed to the surface of the elastic layer.

Moreover, in these coating methods, an ionic conductive agent, conductive fine particles, and resin particles are dispersed in a binder resin to prepare a coating solution of the conductive resin composition. Furthermore, to more readily control the positional relationship, a solvent is preferably used for the coating solution. Particularly, a polar solvent that can dissolve the binder resin and has high affinity with the polymer having a unit derived from ethylene oxide contained in the elastic layer is preferably used.

Specifically, examples of the solvent include: ketones such as acetone, methyl ethyl ketone, methyl isobutyl ketone, and cyclohexanone; alcohols such as methanol, ethanol, and isopropanol; amides such as N,N-dimethylformamide and N,N-dimethylacetamide; sulfoxides such as dimethyl sulfoxide; ethers such as tetrahydrofuran, dioxane, and ethylene glycol monomethyl ether; and esters such as methyl acetate, and ethyl acetate.

As the method of dispersing the binder resin, the conductive fine particle or the like in the coating solution, a solution dispersing method such as a ball mill, a sand mill, a paint shaker, a DYNO-MILL, and a pearl mill can be used.

The reason why formation of the surface layer by the method above leads to easier control of the positional relationship between the resin particles and the graphite particles and/or the graphitized particles exposed to the surface of the elastic layer will be described below.

Figure 4:
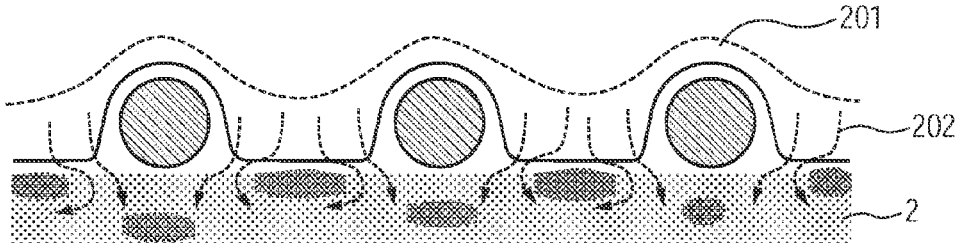
FIG. 4 is a schematic view illustrating a flow of a solvent permeating on the surface of the electro-conductive elastic layer when a coating solution for an electro-conductive surface layer is applied in production of the charging member according to the present invention.

The coating solution of the conductive resin composition is applied to the surface of the elastic layer having the exposed graphite particles and/or graphitized particles by the method above. A wet film (201 in FIG. 4) containing the solvent is formed on the surface of the elastic layer 2. It is thought that the polar solvent in the coating solution permeates into the elastic layer immediately after the coating because the solvent has high affinity with the polymer having a unit derived from ethylene oxide. In contrast, the polar solvent barely permeates into the elastic layer from the surface thereof having the exposed graphite particles and/or graphitized particles which have low affinity with the polar solvent. Because of this difference in permeation of the solvent into the surface of the elastic layer, the coating solution permeates into the elastic layer while a flow indicated by dotted lines (202) in FIG. 4 is being formed. As a result of such a flow of the coating solution, the resin particles dispersed in the coating solution are surely disposed on portions of the surface of the elastic layer having no exposed graphite particles and graphitized particles.

The resin particles used in the present invention can have air-containing regions inside thereof, such as the porous particle or the multi-hollow particle described above. The resin particles having air-containing regions having relatively smaller specific gravities than those of solid resin particles readily follow the flow of the solvent, allowing easier control of the position of the resin particles in the surface layer. Among these, the porous particle can be used because the porous particle has high affinity with the coating solution attributed to a number of micropores penetrating through the surface of the resin particle and more readily follow the flow of the coating solution.

As a premise, the porous particle and multi-hollow particle suitably usable as the resin particles according to the present invention have the original function as the resin particles according to the present invention, that is, have rigidity needed for the function to form a slight gap in the nip between the charging member and the electrophotographic photosensitive member. For this reason, preferable porous particles and multi-hollow particles have the total volume of pores of 10% or more and 50% or less where the total volume of the resin particles containing air-containing regions is 100%.

Moreover, preferably the graphite particle or graphitized particle has the graphite (002) plane lattice spacing of 0.3354 nm or more and 0.3365 nm or less because permeation of the polar solvent to the graphite particles and the graphitized particles can be surely suppressed. Use of such graphite particles and graphitized particles can control the positions of the resin particles in the surface layer to the particle-exposing portions where the graphite particles and the graphitized particles are exposed in the elastic layer with more precision.

Furthermore, to improve the precision of the control of the positions, the "graphite particles and/or graphitized particles" contained in the elastic layer and the "resin particles" contained in the surface layer can be adjusted to have a "ratio of volume average particle sizes ("resin particles"/"graphite particles and/or graphitized particles")" and a "ratio of contents ("resin particles"/"graphite particles and/or graphitized particles")" as follows. The ratio of the volume average particle sizes is 0.08 or more and 35 or less, particularly 0.1 or more and 25 or less, and preferably 0.4 or more and 12 or less. Moreover, the ratio of the contents (parts by mass) is 0.1 or more and 20 or less, particularly 0.4 or more and 15 or less, and preferably 0.7 or more and 10 or less.

A specific example of the method of forming the electroconductive surface layer will be described below.

First, dispersed components other than the resin particles such as conductive fine particles and glass beads having a diameter of 0.8 mm are mixed with a binder resin, and are dispersed with a paint shaker dispersing machine over 5 to 36 hours. Next, the resin particles are added, and dispersed. The dispersion time can be 2 minutes or more and 30 minutes or less. Here, the conditions need to be set so as not to crush the resin particles. Subsequently, the viscosity is adjusted to 3 to 30 mPa·s, and more preferably 3 to 20 mPa·s to prepare a coating solution. Next, a surface layer can be formed on the elastic layer by dipping or the like to have a layer thickness after drying of 0.5 to 50 μm, more preferably 1 to 20 μm, and particularly preferably 1 to 10 μm.

The layer thickness of the surface layer can be measured by cutting out the cross section of the charging member with a sharp knife and observing the cross section with an optical microscope or an electron microscope. Any three points in the longitudinal direction of the charging member and three points in the circumferential direction thereof, nine points in total are measured, and the average value is defined as the layer thickness.

At a large layer thickness or a small amount of the solvent in the coating solution, the flow of the solvent is difficult to occur, leading to difficulties in the control of the positions. Accordingly, the concentration of the solid content in the coating solution is preferably relatively small. The proportion of the solvent in the coating solution is preferably 40% by mass or more, more preferably 50% by mass or more, and particularly preferably 60% by mass or more.

The specific gravity of the coating solution is adjusted to be preferably 0.8000 or more and 1.200 or less, and more preferably 0.9000 or more and 1.000 or less. A specific gravity within this range readily produces the flow of the solvent, and thus the resin particles readily move by the flow. As a result, the positions of the resin particles are more readily controlled. Moreover, more preferably the difference between the specific gravity of the resin particles and the specific gravity of the coating solution is controlled to be smaller because the resin particles move more readily by the flow of the solvent to more readily control the positions.

Moreover, the coating solution after coating can be dried once in an environment of approximately 20 to 50° C. A treatment such as curing or crosslinking can be performed after the drying. It is not preferable that the coating solution immediately after coating be exposed to a high temperature (for example, boiling point of the solvent or more) because such a high temperature highly probably causes explosive boil of the solvent to impair the flow of the solvent described above. In the curing or crosslinking requiring a high temperature, pre-drying can be performed before the curing in an environment of approximately 20 to 30° C. so as not to impair the flow of the solvent. Thereby, the control of the positions can be performed without fail.

[Other Materials]

The electro-conductive surface layer according to the present invention may contain an insulation particle in addition to the conductive fine particle. Examples of the insulation particle include: a particle of zinc oxide, tin oxide, indium oxide, titanium oxides (such as titanium dioxide and titanium monooxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomite, glass beads, bentonite, montmorillonite, hollow glass balls, organic metal compounds, and organic metal salts. Iron oxides such as ferrite, magnetite, and hematite and activated carbon can also be used.

To improve releasing properties, the surface layer may further contain a mold release agent. If the surface layer contains a mold release agent, dirt can be prevented from adhering to the surface of the charging member, improving the durability of the charging member. When the mold release agent is a liquid, the mold release agent also acts as a leveling agent when the resin layer is formed.

The surface layer may be surface treated. Examples of the surface treatment can include surface machining with UV or an electron beam, and surface modification in which a compound is applied to the surface and/or the surface is impregnated with the compound.

[Volume Resistivity]

The volume resistivity of the electro-conductive surface layer according to the present invention can be $1\times10^{2}\Omega\cdot$cm or more and $1\times10^{16}\Omega\cdot$cm or less in a normal temperature and normal humidity environment. At a volume resistivity within this range, the electrophotographic photosensitive member is easier to charge properly by discharging.

The volume resistivity of the surface layer is determined as follows. First, the surface layer is cut out from the charging member into a section having substantially a length of 5 mm, a width of 5 mm, and a thickness of 1 mm. Next, a metal is deposited onto both surfaces of the section to produce a sample for measurement. If the thin film of the surface layer cannot be cut out, a conductive resin composition for forming a surface layer is applied to an aluminum sheet to form a coating, and a metal is deposited on to the coating surface to produce a sample for measurement. A voltage of 200 V is applied to the obtained sample for measurement using a microammeter (trade name: ADVANTEST R8340A ULTRA HIGH RESISTANCE METER, made by Advantest Corporation). The current after 30 seconds is measured. The volume resistivity is determined by calculation from the layer thickness and the electrode area. The volume resistivity of the surface layer can be adjusted by the conductive fine particles and the ionic conductive agent described above.

Moreover, the conductive fine particles preferably have an average particle size of 0.01 to 0.9 m, and particularly 0.01 to 0.5 μm. Thereby, the volume resistivity of the surface layer can be more readily controlled.

<Charging Member>

The charging member according to the present invention may be any charging member including the electro-conductive substrate, the electro-conductive resin layer, and the electro-conductive surface layer. The charging member may be of any form such as a roller and a flat plate. Hereinafter, the charging member will be described in detail using a charging roller as one example of the charging member.

With an adhesive, the electro-conductive substrate may be bonded to the layer disposed immediately above the electro-conductive substrate. In this case, the adhesive can be one having conductivity. To give conductivity, the adhesive can contain a known conductive agent. Examples of the binder for the adhesive include thermosetting resins and thermoplastic resins. Known urethane resins, acrylic resins, polyester resins, polyether resins, and epoxy resins can be used. The conductive agent for giving conductivity to the adhesive can be properly selected from the conductive particles and the ionic conductive agents. These selected conductive agents can be used alone or in combination of two or more.

To charge the electrophotographic photosensitive member well, more preferably, the charging roller according to the present invention usually has an electric resistance value of $1\times10^{3}\Omega$ or more and $1\times10^{10}\Omega$ or less in a normal temperature and normal humidity environment.

Figure 6:
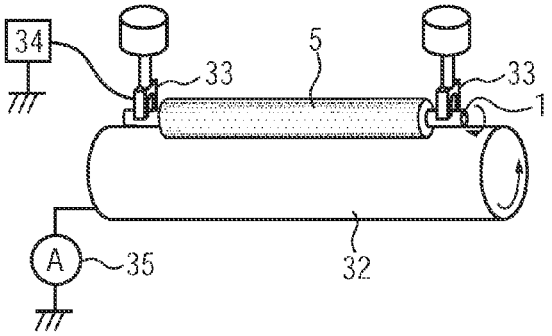
FIG. 6 is a schematic view illustrating an apparatus used for measurement of an electric resistance value of the charging member (in the form of a roller).

As one example, a method of measuring the electric resistance value of the charging roller is shown in FIG. 6. Both ends of the electro-conductive substrate 1 are brought into parallel contact with a cylindrical metal 32 having the same curvature as that of the electrophotographic photosensitive member by bearings 33 to which loads are applied. In this state, while the cylindrical metal 32 is rotated by a motor (not illustrated) to rotate the charging roller 5 contacting the cylindrical metal following the rotation of the cylindrical metal, a DC voltage of −200 V is applied from a stabilized power supply 34. The current flowing at this time is measured with an ammeter 35, and the electric resistance value of the charging roller is calculated. In the present invention, each of the loads is 4.9 N, and the metal cylinder has a diameter ϕ of 30 mm and rotates at a circumferential speed of 45 mm/sec.

From the viewpoint of a uniform nip width in the longitudinal direction with respect to the electrophotographic photosensitive member, the charging roller according to the present invention can have a crown shape in which the central portion in the longitudinal direction of the charging member is the thickest and the thickness of the charging roller reduces toward the ends in the longitudinal direction. For the crown amount (average value of the difference between the outer diameter d1 of the central portion and the outer diameters d2 90 mm spaced from the central portion) can be 30 μm or more and 200 μm or less.

The hardness of the surface of the charging member is preferably 90° or less, and more preferably 40° or more and 80° or less as a value measured with a microdurometer (MD-1). At a hardness within this range, the contact state of the charging member and the electrophotographic photosensitive member is easily stabilized, and discharge within the nip can be more stably performed.

The surface of the charging member preferably has a ten-point average roughness (Rzjis) of 8 μm or more and 100 μm or less, and more preferably 12 μm or more and 60 μm or less. The average interval between the concavity and the protrusion (RSm) of the surface is preferably 20 μm or more and 300 μm or less, and more preferably 50 μm or more and 200 μm or less. At Rzjis and Rsm within these ranges, a gap is easily formed in the nip between the charging member and the electrophotographic photosensitive member, and discharge within the nip can be stably performed.

The ten-point average roughness and the average interval between the concavity and the protrusion are measured according to the specification of surface roughness in JIS B 0601-1994 with a surface roughness analyzer "SE-3500" (trade name, made by Kosaka Laboratory Ltd.). The ten-point average roughness is the average value of values obtained by measuring any six places of the charging member. Moreover, the average interval between the concavity and the protrusion is determined as follows. Ten intervals between a depression and a projection are measured in the six places of the charging member to determine the average values in the six places, and the average values of the six places are averaged to determine the average interval between the concavity and the protrusion. In the measurement, a cut-off value is set at 0.8 mm, and the length for evaluation is set to 8 mm.

<Process Cartridge>

The process cartridge according to the present invention is a process cartridge including the charging member according to the present invention integrated with a charged member (electrophotographic photosensitive member), and configured to be detachably mountable on an electrophotographic apparatus.

Figure 8:
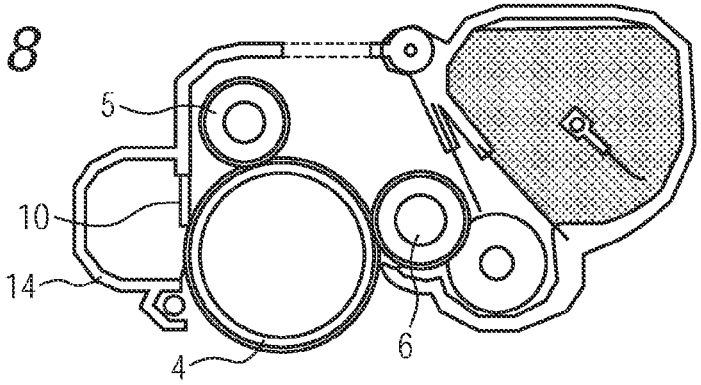
FIG. 8 is a schematic view illustrating a cross section of one example of a process cartridge according to the present invention.

FIG. 8 shows a process cartridge detachably mountable on an electrophotographic apparatus in which an electrophotographic photosensitive member, a charging apparatus, a developing apparatus, a cleaning apparatus, and the like are integrated. The charging member according to the present invention can be used as the charging apparatus.

<Electrophotographic Apparatus>

The electrophotographic apparatus according to the present invention is an electrophotographic apparatus including the charging member according to the present invention, and an electrophotographic photosensitive member disposed to be chargeable by the charging member.

Figure 7:
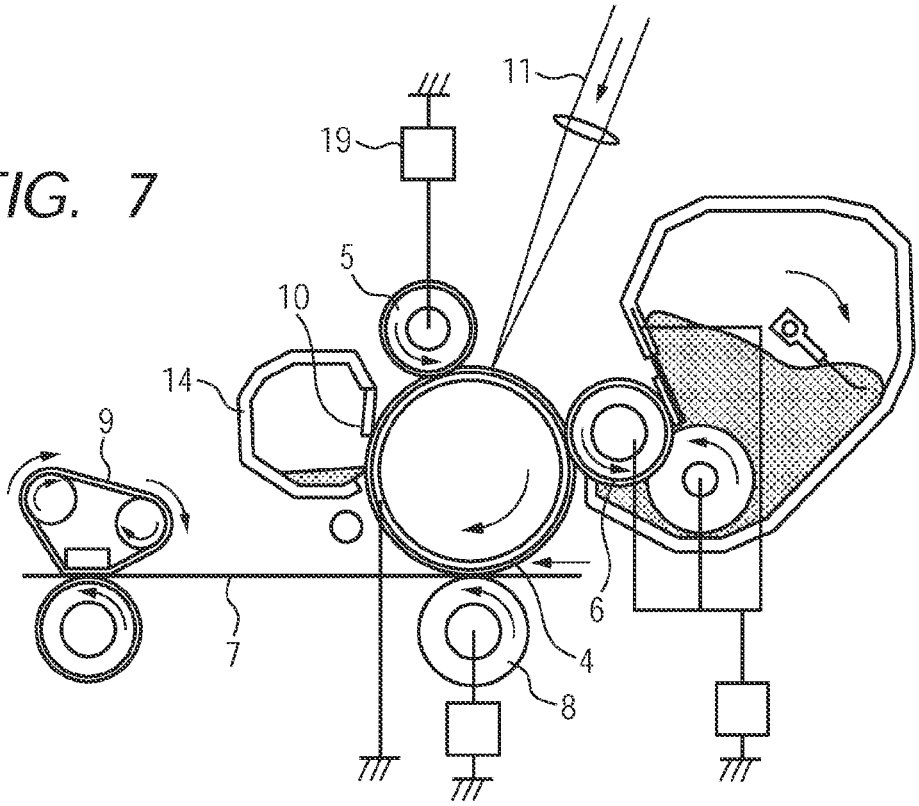
FIG. 7 is a schematic view illustrating a cross section of one example of an electrophotographic apparatus according to the present invention.

FIG. 7 is a diagram showing a schematic configuration of one example of an electrophotographic apparatus including the charging member according to the present invention. The electrophotographic apparatus includes an electrophotographic photosensitive member, a charging apparatus for charging the electrophotographic photosensitive member, a latent image forming apparatus for performing exposure to form a latent image, a developing apparatus for developing the latent image into a toner image, a transfer apparatus for transferring the toner image onto a transfer material, a cleaning apparatus for recovering a transferred toner on the electrophotographic photosensitive member, a fixing apparatus for fixing the toner image, for example.

An electrophotographic photosensitive member 4 is a rotary drum type member having a photosensitive layer on the electro-conductive substrate. The electrophotographic photosensitive member is rotatably driven in the arrow direction at a predetermined circumferential speed (process speed). The charging apparatus includes a contact type charging roller 5 which is brought into contact with the electrophotographic photosensitive member 4 at a predetermined pressure to be contact disposed. The charging roller 5 rotates following the rotation of the electrophotographic photosensitive member. A predetermined DC voltage is applied from a power supply for charging 19 to charge the electrophotographic photosensitive member to a predetermined potential.

For a latent image forming apparatus 11 for forming an electrostatic latent image on the electrophotographic photosensitive member 4, an exposure apparatus such as a laser beam scanner is used. An electrostatic latent image is formed by exposing a uniformly charged electrophotographic photosensitive member in correspondence with image information. The developing apparatus includes a developing sleeve or developing roller 6 disposed close to or in contact with the electrophotographic photosensitive member 4. Using an electrostatically treated toner to have the same polarity as the charging polarity of the electrophotographic photosensitive member, an electrostatic latent image is developed by reversal development to form a toner image. The transfer apparatus includes a contact type transfer roller 8. The toner image is transferred from the electrophotographic photosensitive member onto a transfer material 7 such as normal paper. The transfer material is conveyed by a sheet feeding system having a conveying member.

The cleaning apparatus includes a blade type cleaning member 10 and a recovering container 14. After transfer, the cleaning apparatus mechanically scrapes off the transfer remaining toner left on the electrophotographic photosensitive member and recovers the toner. Here, the cleaning apparatus can be eliminated by adopting a simultaneous developing and cleaning method in which the transfer remaining toner is recovered with the developing apparatus. The fixing apparatus 9 is composed of a heated roller or the like. The fixing apparatus 9 fixes the transferred toner image on the transfer material 7, and discharges the transfer material to the outside of the apparatus.

EXAMPLES

Hereinafter, the present invention will be described in more detail according to Examples. First, prior to Examples, methods for measuring a variety of parameters, Production Examples 1 to 25 of graphite particles and graphitized particles, Production Examples 1 to 16 of resin particles, and Production Examples 1 and 2 of conductive fine particles in the present invention will be described. In the respective particles, the "average particle size" means a "volume average particle size" unless otherwise specified.

<1. Methods for Measuring a Variety of Parameters>

[1-1. Measurement of Graphite (002) Plane Lattice Spacing of Graphite Particles and Graphitized Particles]

In Graphite particles A1 to A25 described later, the plane lattice spacing is measured under the following conditions with a sample horizontal high-power X ray diffractometer (trade name: RINT/TTR-II; made by Rigaku Corporation) to produce an X ray diffraction chart. Moreover, for the graphite particles and graphitized particles contained in the elastic layer, first, approximately 50 mg of the graphite particles or graphitized particles are taken from the elastic layer. The sample is measured with the diffractometer to produce the X ray diffraction chart.

The peak position of the diffraction line from the graphite (002) plane is determined from the X ray diffraction chart. The graphite (002) plane lattice spacing (graphite d(002)) is calculated from Bragg's expression represented by the following expression (1). The results are shown in Table 1.

$$\text{graphite } d(002)=\lambda/(2\times\sin\theta) \qquad \text{Expression (1).}$$

[Measurement Conditions]

sample mass: 50 mg
source of rays: CuKα rays (wavelength λ=0.15418 nm)
optical system: parallel beam optical system
goniometer: rotor horizontal goniometer (TTR-2)
tube voltage/current: 50 kV/300 mA
measurement method: continuous method
scanning axis: 2θ/θ
measurement angle: 10° to 50°
sampling interval: 0.02°
scanning rate: 4°/min.
divergence slit: opened
vertical divergence slit: 10 mm
scattering slit: opened
photoreception slit: 1.00 mm.

[1-2. Measurement of Raman Spectrum Half Width of Graphite Particles and Graphitized Particles]

For the particles contained in the elastic layer, the graphite particles or graphitized particles are cut out from the elastic layer, and used as a sample for measurement. Moreover, the graphite particles or the graphitized particles themselves are used as a sample for measurement. These samples are measured with a Raman spectrometer (trade name: LabRAM HR; made by HORIBA JOBIN YVON, Ltd.) under the following measurement conditions. In the measurement, a band width of a Raman band at a height corresponding to ½ of a peak present in a region of 1570 $cm^{-1}$ to 1630 $cm^{-1}$ is calculated.

[Main Measurement Conditions]

laser: He—Ne laser (peak wavelength: 632 nm)

filter: D 0.3, hole: 1000 μm, slit: 100 μm center spectrum: 1500 $cm^{-1}$, measurement time: 1 second× 16 times, grating: 1800, object lens: ×50.

[1-3. Measurement of Stereoscopic Particle Shape of Particle]

The shapes of Graphite particles and Graphitized particles A1 to A25 and Resin particle B1 to B18 themselves are measured by the following method. First, in a variety of particles to be measured, secondarily aggregated particles are removed and only primary particles are embedded with a visible light-transitive curable resin (trade name: D-800, made by Nisshin EM Corporation). The resin cured material having the embedded particles is cut by 20 nm with a focused ion beam machining observation apparatus (trade name: FB-2000C, made by Hitachi, Ltd.), and the cross section images of the cut samples are photographed. The photographed cross section images of the same particle are combined at an interval of 20 nm, and the "stereoscopic particle shape" of the target particle is calculated. This operation is performed on any 100 particles.

Moreover, for the particles contained in the elastic layer or the surface layer, any 10 places of the charging member are selected for the measurement. At the selected one place for the measurement, any point over 500 μm in the longitudinal direction, a region of 500 μm in the circumferential direction and 500 μm in the depth direction from the surface layer to the elastic layer is cut out by nm with the focused ion beam machining observation apparatus, and the cross section images are photographed. The photographed images of the same particle are combined at an interval of 20 nm, and the stereoscopic particle shape is calculated. This operation is performed on any photographed 10 particles. The same operation is performed at other 9 places, and 100 "stereoscopic particle shapes" in total are calculated.

In the photographed cross section image, the resin portion is seen gray and the air region is seen white. Thereby, the resin portion can be distinguished from the air portion.

[1-4. Volume Average Particle Size of Resin Particles]

For the particle having the "stereoscopic particle shape" obtained by the method in [1-3] above, the total volume including air-containing regions is calculated, and a diameter of a sphere having a volume equal to the volume is determined. The average particle size of 100 of the obtained diameters is calculated to be defined as the "volume average particle size dv" of the particle.

[1-5. Proportion of Air-Containing Region in Resin Particle]

From a plurality of the cross section images used for calculation of the "stereoscopic particle shape" obtained by the method in [1-3] above, the air-containing region is calculated. The proportion of the volume of the air-containing region to the total volume of the air-containing region and a resin region in the resin particle is calculated. The average value is defined as the proportion of the air-containing region in the resin particle.

[1-6. Hollow Diameter of Resin Particle]

From the "stereoscopic particle shape" obtained by the method in [1-3] above, of the air-containing regions, 10 portions of the resin particle not penetrating through the surface (hollow portion) are selected at random, and the volume of the selected portions is calculated. A diameter of a sphere having a volume equal to the volume is determined. This operation is performed on any 10 resin particles, and the average diameter of 100 of the obtained diameters in total is calculated. The average diameter is defined as a hollow diameter $d_H$ of the resin particle.

[1-7. Micropore Diameter of Resin Particle]

From the "stereoscopic particle shape" obtained by the method in [1-3] above, of the air-containing regions, 10 portions of the resin particle penetrating through the surface (micropore portion) are selected at random, and the cross section images thereof are photographed. From the cross section images, the area of the cross sections of the micropore portions is calculated, and a diameter of a circle having an area equal to the area is determined. This operation is performed on any 10 resin particles, and the average diameter of 100 of the obtained diameters in total is calculated. The average diameter is defined as a micropore diameter $d_p$ of the resin particle.

[1-8. Volume Average Particle Size Dv of Graphite Particles and Graphitized Particles]

For the particles excluding the graphite particles and the graphitized particles exposed from the elastic layer (that is, the particles present in the elastic layer), the "stereoscopic particle shape" obtained by the method in [1-3] above is calculated. The average value of 100 of the obtained stereoscopic particle shapes is defined as a volume average particle size Dv.

[1-9. Ratio Long Diameter $D_L$/Short Diameter $D_S$ of Graphite Particles and Graphitized Particles]

For the particles excluding the graphite particles and the graphitized particles exposed from the elastic layer (that is, the particles present in the elastic layer), the "stereoscopic particle shape" obtained by the method in [1-3] above is calculated. From the "stereoscopic particle shape", largest diameter/smallest diameter of the particle is measured, and the average value of 100 particles is defined as the ratio long diameter/short diameter ($D_L/D_s$).

[1-10. Examination of positional relationship between resin particles and graphite particles and graphitized particles on surface of elastic layer]

The stereoscopic particle shapes of the graphite particles and graphitized particles exposed from the elastic layer are calculated by the method in [1-3] above, and the calculated stereoscopic particle shapes of the resin particles are orthographically projected onto the surface of the elastic layer at the same time. This operation is performed on any 10 places of the charging member to examine the positional relationship.

<2. Production Examples of Graphite Particles and Graphitized Particles>

[Production Example A1] Production of Graphite Particle A1

Flake graphite particles (made by Ito Kokuen Co., Ltd.: CPN35 (trade name)) were crushed to have an average particle size of 6 μm, and were classified to produce Graphite particle A1.

[Production Examples A2 and A6] Production of Graphite particles A2 and A6

Graphite particles A2 and A6 were produced in the same manner as in Production Example A1 except that flake graphite particles were crushed to have an average particle size of 3 or 2 μm, and were classified.

[Production Example A3] Production of Graphite Particle A3

Flake graphite particles (made by Ito Kokuen Co., Ltd.: X-100 (trade name)) were crushed to have an average particle size of 10 μm, and were classified to produce Graphite particle A3.

[Production Examples A4 and A5] Production of Graphite Particles A4 and A5

Flake graphite particles (made by Ito Kokuen Co., Ltd.: Z-50 (trade name)) were crushed to have an average particle size of 10 or 40 μm, and were classified to produce Graphite particles A4 and A5, respectively.

[Production Example A7] Production of Graphite Particle A7

Flake graphite particles (made by Ito Kokuen Co., Ltd.: XD-100 (trade name)) were crushed to have an average particle size of 70 μm, and were classified to produce Graphite particle A7.

[Production Examples A8 and A9] Production of Graphitized Particles A8 and A9

A carbon heavy oil was heated to produce crude mesocarbon microbeads. The crude mesocarbon microbeads were centrifuged, washed with benzene to be refined, and dried. Then, the dried mesocarbon microbeads were mechanically dispersed with an atomizer mill to produce mesocarbon microbeads. The mesocarbon microbeads were heated under a nitrogen atmosphere to 1200° C. at a temperature raising rate of 600° C./h to be carbonized. The carbonized mesocarbon microbeads were secondarily dispersed with the atomizer mill. At this time, the average particle size was adjusted to approximately 3 μm. The produced dispersion was heated under a nitrogen atmosphere to 3500° C. at a temperature raising rate of 1000° C./h to perform a heat treatment at 3500° C. for 15 minutes. Furthermore, the product was classified to produce Graphitized particle A8. Subsequently, Graphitized particles A8 were crushed, and were classified to produce Graphitized particle A9.

Production Examples A10 to A12

Production of Graphitized Particles A10 to A12

In Production Example A8, during the secondary dispersion with the atomizer mill, the average particle size was adjusted to approximately 50 μm. The produced dispersion was heated under a nitrogen atmosphere to 3000° C. at a temperature raising rate of 1000° C./h to perform a heat treatment at 3000° C. for 15 minutes. Furthermore, the product was classified to produce Graphite particle A10. Subsequently, Graphitized particles A10 were crushed, and were classified to produce Graphitized particles A11 and A12.

Production Examples A13 to A15

Production of Graphitized Particles A13 to A15

A β-resin was extracted from a coal tar pitch by solvent fractionation. The β-resin was hydrogenated to be densified. Then, a solvent soluble content was removed with toluene to produce a bulk mesophase pitch. The bulk mesophase pitch was mechanically crushed, and was heated in the air to 270° C. at a temperature raising rate of 300° C./h to be oxidized. The bulk mesophase pitch was crushed to have an average particle size of approximately 50 μm. Then, the bulk mesophase pitch was heated under a nitrogen atmosphere to 3000° C. at a temperature raising rate of 1500° C./h to perform a heat treatment at 3000° C. for 15 minutes. Furthermore, the product was classified to produce Graphite particle A13. Subsequently, Graphitized particles A13 were further crushed, and were classified to produce Graphitized particles A14 and A15.

Production Examples A16 and A17

Production of Graphitized particles A16 and A17

Flake graphite particles (made by Ito Kokuen Co., Ltd.: AGB-604 (trade name)) were crushed to have an average particle size of 40 μm and 50 μm, and were classified to produce Graphitized particles A16 and A17, respectively.

Production Examples A18 to A20

Production of Graphitized particles A18 to A20

In Production Example A10, during the secondary dispersion with the atomizer mill, the average particle size was adjusted to approximately 100 μm. The produced dispersion was heated under a nitrogen atmosphere to 2000° C. at a temperature raising rate of 1000° C./h to perform a heat treatment at 2000° C. for 15 minutes. Furthermore, the product was classified to produce Graphitized particle A18. Subsequently, Graphitized particles A18 were further crushed, and were classified to produce Graphitized particles A19 and A20.

Production Example A21

Production of Graphitized Particle A21

A coal tar was distilled to remove a light oil having a boiling point of 270° C. or less. 85 parts by mass of acetone was mixed based on 100 parts by mass of the coal tar, and stirred at room temperature. The produced insoluble content was removed by filtration. Acetone was separated by distillation of the filtrate to produce a refined coal tar. 10 parts by mass of concentrated nitric acid was added based on 100 parts by mass of the refined coal tar. The mixture was polycondensed in a reduced pressure distillation tank at 350° C. for one hour, and was heated at 480° C. for 4 hours. The product was cooled, extracted, and mechanically crushed. The crushed product was heated under a nitrogen atmosphere to 1000° C. at a temperature raising rate 10° C./h to perform a heat treatment (primary heat treatment) at 1000° C. for 10 hours. During the crushing, the average particle size was adjusted to approximately 3 μm. Then, the product was heated under a nitrogen atmosphere to 3000° C. at a temperature raising rate of 10° C./h to perform a heat treatment (secondary heat treatment) at 3000° C. for one hour. Furthermore, the product was classified to produce Graphitized particle A21.

Production Example A22

Production of Graphitized particle A22

Phenol resin particles having an average particle size of 2.3 μm were heat stabilized under an oxidizing atmosphere at 300° C. for one hour, and were heated to 2200° C. at 1100° C./h to perform a heat treatment at 2200° C. for 10 minutes. Furthermore, the product was classified to produce Graphitized particle A22.

Production Example A23

Production of Graphitized Particle A23

Graphitized particle A23 was produced in the same manner as in Production Example A22 except that the average particle size of the phenol resin particles was 70 μm.

Production Example A24

Production of Graphitized Particle A24

The average particle size of the phenol resin particles was 96 μm. The phenol resin particles were heated at 750° C./h to 1500° C. to perform a heat treatment at 1500° C. for 10 minutes. The classifying conditions were changed. Except these, Graphitized particle A24 was produced in the same manner as in Production Example A23.

Production Example A25

Production of Graphitized Particle A25

The average particle size of the phenol resin particles was 83 μm. The phenol resin particles were heated at 500° C./h to 1000° C. to perform a heat treatment at 1000° C. for 2 minutes. The classifying conditions were changed. Except these, Graphitized particle A25 was produced in the same manner as in Production Example A24.

[Evaluation of Properties of Graphite Particles and Graphitized Particles]

In Graphite particles and Graphitized particles A1 to A25 produced in Production Examples, the volume average particle size, the ratio of long diameter/short diameter, the graphite (002) plane lattice spacing, and the half width of the Raman spectrum were measured. The results are shown in Table 1.

TABLE 1

| Types of particles | Volume average particle size (μm) | Ratio of long diameter/short diameter | Graphite (002) plane lattice spacing (nm) | Half width ($cm^{-1}$) |
|---|---|---|---|---|
| Graphite particle A1 | 6.1 | 1.7 | 0.3354 | 19 |
| Graphite particle A2 | 3.2 | 1.8 | 0.3354 | 19 |
| Graphite particle A3 | 10.6 | 2.1 | 0.3355 | 21 |
| Graphite particle A4 | 10.2 | 2 | 0.3354 | 20 |
| Graphite particle A5 | 40.5 | 2.2 | 0.3354 | 19 |
| Graphite particle A6 | 2.8 | 2 | 0.3354 | 21 |
| Graphite particle A7 | 68 | 2.4 | 0.3355 | 22 |
| Graphitized particle A8 | 3.2 | 2.3 | 0.3359 | 23 |
| Graphitized particle A9 | 3.4 | 2.2 | 0.3359 | 23 |
| Graphitized particle A10 | 6.7 | 2 | 0.3360 | 24 |
| Graphitized particle A11 | 51 | 2.3 | 0.3360 | 23 |
| Graphitized particle A12 | 2.1 | 2.4 | 0.3360 | 25 |
| Graphitized particle A13 | 3.5 | 1.2 | 0.3362 | 25 |
| Graphitized particle A14 | 8.9 | 1.4 | 0.3362 | 25 |
| Graphitized particle A15 | 51 | 1.5 | 0.3363 | 24 |
| Graphitized particle A16 | 42 | 2 | 0.3357 | 20 |
| Graphitized particle A17 | 52 | 2.1 | 0.3357 | 20 |
| Graphitized particle A18 | 95 | 1.8 | 0.3365 | 30 |
| Graphitized particle A19 | 51 | 1.6 | 0.3365 | 28 |
| Graphitized particle A20 | 63 | 1.8 | 0.3365 | 29 |
| Graphitized particle A21 | 3.5 | 1.4 | 0.3375 | 38 |
| Graphitized particle A22 | 2.2 | 1.1 | 0.3420 | 55 |
| Graphitized particle A23 | 71 | 1.3 | 0.3430 | 56 |
| Graphitized particle A24 | 94 | 1.9 | 0.3580 | 79 |
| Graphitized particle A25 | 73 | 2.2 | 0.3650 | 81 |

<3. Production Examples of Resin Particles>

Production Example B1

Production of Resin Particle B1

8 parts by mass of tricalcium phosphate was added to 400 parts by mass of deionized water to prepare an aqueous medium. Next, 20 parts by mass of methyl methacrylate, 10 parts by mass of 1,6-hexanediol methacrylate, 75 parts by mass of n-hexane, and 0.3 parts by mass of benzoyl peroxide were mixed to prepare an oily mixed solution. The oily mixed solution was dispersed in the aqueous medium at the number of rotation of 3000 rpm with a homomixer. Subsequently, the obtained solution was charged into a polymerization reaction container whose inside was replaced by nitrogen. While the solution was being stirred at 250 rpm, suspension polymerization was performed at 60° C. over 6 hours. Thus, an aqueous suspension containing the porous resin particle and n-hexane was obtained. To the aqueous suspension, 0.4 parts by mass of sodium dodecylbenzenesulfonate was added, and the concentration of sodium dodecylbenzenesulfonate was adjusted to be 0.1% by mass based on water.

The obtained aqueous suspension was distilled to remove n-hexane, and the remaining aqueous suspension was repeatedly filtered and washed with water. Then, drying was performed at 80° C. for 5 hours. The product was crushed and classified with a sonic classifier to obtain a resin particle B1 having an average particle size of 30.5 μm. The cross section of the particle was observed by the method described above. Resin particle B1 was found to be a porous particle having a number of micropores of approximately 30 nm to 50 nm inside thereof.

Production Examples B2 to B4

Production of Resin Particles B2, B3 and B4

Resin particles B2, B3, and B4 were produced in the same manner as in Production Example B1 except that the number of rotations of the homomixer was changed to 4500 rpm, 5000 rpm, and 2500 rpm, respectively. These resin particles were found to be a porous particle as Resin particle B1.

Production Example B5

Production of Resin Particle B5

To 300 parts by mass of deionized water, 10.5 parts by mass of tricalcium phosphate and 0.015 parts by mass of sodium dodecylbenzenesulfonate were added to prepare an aqueous medium. Next, 65 parts by mass of lauryl methacrylate, 30 parts by mass of ethylene glycol dimethacrylate, 5 parts by mass of poly(ethylene glycol-tetramethylene glycol) monomethacrylate, and 0.5 parts by mass of azobisisobutyronitrile were mixed to prepare an oily mixed solution. The oily mixed solution was dispersed in the aqueous medium at the number of rotation of 4000 rpm with a homomixer. Subsequently, the obtained solution was charged into a polymerization reaction container whose inside was replaced by nitrogen. While the solution was being stirred at 250 rpm, suspension polymerization was performed at 70° C. over 8 hours. After cooling, hydrochloric acid was added to the obtained suspension to decompose calcium phosphate. Further, filtration and washing with water were repeated. After drying at 80° C. for hours, the product was crushed and classified with a sonic classifier to produce Resin particle B5 having an average particle size of 35.2 μm. The cross section of the particle was observed by the method described above. Resin particle B5 was found to be a multi-hollow particle having a plurality of hollow portions inside of the particle. The hollow portions had a volume average particle size of 3.5 μm.

Production Examples B6, B11, B14, and B15

Production of Resin Particles B6, B11, B14, and B15

Resin particles B6, B11, B14, and B15 were produced in the same manner as in Production Example B5 except that the number of rotations of the homomixer was changed to 3500 rpm, 2700 rpm, 3000 rpm, and 2500 rpm, respectively. These resin particles were found to be a multi-hollow particle as Resin particle B5.

Production Example B7

Production of Resin Particle B7

8 parts by mass of polyvinyl alcohol (saponification degree: 85%) was added to 400 parts by mass of deionized water to prepare an aqueous medium. Next, 6.5 parts by mass of methyl methacrylate, 6.5 parts by mass of styrene, 9 parts by mass of divinylbenzen, 85 parts by mass of n-hexane, and 0.3 parts by mass of lauroyl peroxide were mixed to prepare an oily mixed solution. The oily mixed solution was dispersed in the aqueous medium with a homomixer at the number of rotations of 2000 rpm. Subsequently, the oily mixed solution was placed in a polymerization reaction container replaced with nitrogen, and was suspension polymerized over 6 hours at 60° C. while being stirred at 250 rpm. An aqueous suspension containing porous resin particles and n-hexane was prepared. Then, Resin particle B7 was produced in the same manner as in Production Example B1. The resin particle was found to be a porous particle as Resin particle B1.

Production Example B8

Production of Resin Particle B8

Resin particle B8 was produced in the same manner as in Production Example B7 except that the number of rotations of the homomixer was 1800 rpm. The resin particle was found to be a porous particle as Resin particle B1.

Production Example B9

Production of Resin Particle B9

8 parts by mass of tricalcium phosphate was added to 400 parts by mass of deionized water to prepare an aqueous medium. Next, 33 parts by mass of methyl methacrylate, 17 parts by mass of 1,6-hexanediol methacrylate, 50 parts by mass of n-hexane, and 0.3 parts by mass of benzoyl peroxide were mixed to prepare an oily mixed solution. The oily mixed solution was dispersed in the aqueous medium with a homomixer at the number of rotations of 4800 rpm. Subsequently, the oily mixed solution was placed in a polymerization reaction container replaced with nitrogen, and was suspension polymerized over 6 hours at 60° C. while being stirred at 250 rpm. An aqueous suspension containing porous resin particles and n-hexane was prepared. To the aqueous suspension, 0.2 parts by mass of sodium lauryl sulfate was added. The concentration of sodium lauryl sulfate was adjusted to 0.05% by mass of water. Then, Resin particle B9 was produced in the same manner as in Production Example B1. The resin particle was found to be a porous particle as Resin particle B1.

Production Example B10 and B12

Production of Resin Particles B10 and B12

Crosslinked polymethyl methacrylate resin particles (trade name: MBX-30, made by SEKISUI PLASTICS CO., Ltd.) were classified to produce Resin particles B10 and B12 having a volume average particle size of 18.2 m and 12.5 μm, respectively. The resin particles in Production Examples B10 and B12 had no pore inside thereof.

Production Example B13

Production of Resin Particle B13

Resin particle B13 was produced in the same manner as in Production Example B8 except that the number of rotations of the homomixer was 1500 rpm. The resin particle was found to be a porous particle as Resin particle B1.

Production Example B16

Production of Resin Particle B16

Resin particle B16 was produced in the same manner as in Production Example B9 except that the number of rotations of the homomixer was 5000 rpm. The resin particle was found to be a porous particle as Resin particle B1.

[Evaluation of Properties of Resin Particles]

In Resin particles B1 to B16 produced in Production Examples, the volume average particle size, the shape of the particle, the average diameter of the hollow portion (hollow diameter of the resin particle $d_H$), the number of hollow portions (plural or not), the average diameter of the micropore (micropore diameter of the resin particle $d_P$), and the proportion of the air-containing region in the particle were measured. The results are shown in Table 2.

TABLE 2

| Types of particles | Volume average particle size (μm) | Shape of particle | Average diameter of hollow portion (μm) | The number of hollow portions | Average diameter of micropore (nm) | Proportion of air-containing region in resin particle (%) |
|---|---|---|---|---|---|---|
| Resin particle B1 | 30.5 | Porous particle | 0.092 | Plural | 20 | 28 |
| Resin particle B2 | 20.2 | Porous particle | 0.085 | Plural | 50 | 21 |
| Resin particle B3 | 18.3 | Porous particle | 0.11 | Plural | 31 | 19 |
| Resin particle B4 | 35.3 | Porous particle | 0.12 | Plural | 21 | 32 |
| Resin particle B5 | 35.2 | Multi-hollow particle | 3.5 | Plural | 21 | 25 |
| Resin particle B6 | 41.0 | Multi-hollow particle | 4.2 | Plural | 32 | 28 |
| Resin particle B7 | 49.0 | Porous particle | 0.081 | Plural | 21 | 29 |
| Resin particle B8 | 51.0 | Porous particle | 0.15 | Plural | 32 | 31 |
| Resin particle B9 | 10.5 | Porous particle | 0.12 | Plural | 25 | 20 |
| Resin particle B10 | 18.2 | Solid particle | — | — | — | 0 |
| Resin particle B11 | 50.2 | Multi-hollow particle | 4.5 | Plural | 32 | 31 |
| Resin particle B12 | 12.5 | Solid particle | — | — | — | 0 |
| Resin particle B13 | 60.0 | Porous particle | 0.15 | Plural | 21 | 32 |
| Resin particle B14 | 45.2 | Multi-hollow particle | 4.0 | Plural | 23 | 35 |
| Resin particle B15 | 62.0 | Multi-hollow particle | 3.5 | Plural | 34 | 29 |
| Resin particle B16 | 8.4 | Porous particle | 0.11 | Plural | 32 | 34 |
| Resin particle B17 | 8.2 | Solid particle | — | — | — | 0 |
| Resin particle B18 | 12.1 | Solid particle | — | — | — | 0 |

<4. Production Examples of Conductive Fine Particle>

Production Example C1

Production of Composite Conductive Fine Particle 140 g of methyl hydrogen polysiloxane was added to 7.0 kg of a silica particle (average particle size: 15 nm, volume resistivity: $1.8\times10^{12}$ μΩ·cm) while an edge runner was operated, and mixed and stirred at a line load of 588 N/cm (60 kg/cm) for 30 minutes. At this time, the stirring rate was 22 rpm. 7.0 kg of carbon black "#52" (trade name, made by Mitsubishi Chemical Corporation) was added to the mixture over 10 minutes while the edge runner was operated, and further mixed and stirred at a line load of 588 N/cm (60 kg/cm) over 60 minutes. Thus, carbon black was adhered to the surface of the silica particle coated with methyl hydrogen polysiloxane. Then, drying was performed at 80° C. for 60 minutes with a dryer to prepare a composite conductive fine particle. At this time, the stirring rate was 22 rpm. The obtained composite conductive fine particle had an average particle size of 15 nm and a volume resistivity of $1.1\times10^{2}$Ω·cm.

Production Example C2

Production of Surface Treated Titanium Oxide Particle 110 g of isobutyltrimethoxysilane as a surface treatment agent and 3000 g of toluene as a solvent were blended with 1000 g of a needle-like rutile titanium oxide particle (average particle size: 15 nm, length:width=3:1, volume resistivity: $2.3\times10^{10}$Ω·cm) to prepare a slurry. After the slurry was mixed with a stirrer for 30 minutes, the slurry was fed to a Visco Mill having glass beads having an average particle size of 0.8 mm filled up to 80% of the effective inner volume. Then, the slurry was wet crushed at a temperature of 35±5° C. Using a kneader, toluene was removed from the slurry obtained by the wet crushing by reduced pressure distillation (bath temperature: 110° C., product temperature: 30 to 60° C., reduced pressure degree: approximately 100 Torr). Then, a surface treatment agent was baked to the slurry at 120° C. for 2 hours. The baked particle was cooled to room temperature, and then ground using a pin mill to produce a surface treated titanium oxide particle. The surface treated titanium oxide particle obtained had an average particle size of 15 nm and a volume resistivity of $5.2\times10^{15}$Ω·cm.

Example 1

[1. Preparation of Electro-Conductive Substrate]

A thermosetting adhesive containing 10% by mass of carbon black was applied to a stainless steel substrate having a diameter of 6 mm and a length of 244 mm, and dried. The obtained product was used as the electro-conductive substrate.

(2. Preparation of Conductive Rubber Composition)

Eight other materials shown in Table 3 below were added to 100 parts by mass of an epichlorohydrin rubber (EO-EP-AGE ternary copolymer, EO/EP/AGE=73 mol %/23 mol %/4 mol %), and kneaded for 10 minutes with a sealed type mixer adjusted at 50° C. to prepare a raw material compound.

TABLE 3

| Material | Amount in use (parts by mass) |
|---|---|
| Epichlorohydrin rubber (EO-EP-AGE ternary copolymer, EO/EP/AGE = 73 mol %/23 mol %/4 mol %) | 100 |
| Calcium carbonate (trade name: Silver-W, made by Shiraishi Kogyo Kaisha, Ltd.) | 80 |
| Adipic acid ester (trade name: POLYCIZER W305ELS, made by DIC Corporation) | 8 |
| Zinc stearate (trade name: SZ-2000, made by Sakai Chemical Industry Co., Ltd.) | 1 |
| 2-Mercaptobenzimidazole (MB) (antioxidant) | 0.5 |
| Zinc oxide (trade name: two zinc oxides, made by Sakai Chemical Industry Co., Ltd.) | 2 |
| Quaternary ammonium salt "ADK CIZER LV-70" (trade name, made by ADEKA Corporation) | 2 |
| Carbon black "Thermax Floform N990" (trade name, made by Cancarb Ltd., Canada, average particle size: 270 nm) | 5 |
| Graphite particle A1 | 20 |

EO: Ethylene oxide,
EP: Epichlorohydrin,
AGE: Allyl glycidyl ether 0.8 Parts by mass of sulfur as a vulcanizing agent and 1 part by mass of dibenzothiazyl sulfide (DM) and 0.5 parts by mass of tetramethyl thiuram monosulfide (TS) as vulcanization accelerators were added to the raw material compound. Next, the mixture was kneaded for 10 minutes with a two-roll mill whose temperature was cooled to 20° C. to prepare a conductive rubber composition. At this time, the interval of the two-roll mill was adjusted to be 1.5 mm.

(3. Preparation of Elastic Roller)

Using an extrusion molding apparatus including a cross-head, the electro-conductive substrate was used as the center shaft, and its outer periphery was coaxially coated with the conductive rubber composition to obtain a rubber roller. The thickness of the coating rubber composition was adjusted to be 1.75 mm.

After the rubber roller was heated at 160° C. for one hour in a hot air furnace, ends of the elastic layer were removed such that the length was 226 mm. Furthermore, the roller was secondarily heated at 160° C. for one hour to produce a roller including a preparative coating layer having a layer thickness of 1.75 mm. The outer peripheral surface of the produced roller was polished using a plunge cutting mode cylinder polisher. A vitrified grinding wheel was used as the polishing grinding wheel. The abrasive grain was green silicon carbide (GC), and the grain size was 100 mesh. The number of rotation of the roller was 350 rpm, and the number of rotation of the polishing grinding wheel was 2050 rpm. The rotational direction of the roller was the same as the rotational direction of the polishing grinding wheel (following direction). The cutting speed was changed stepwise from 10 mm/min to 0.1 mm/min from a time when the grinding wheel is brought into contact with the unpolished roller to a time when the roller was polished to ϕ9 mm. The spark-out time (time at a cutting amount of 0 mm) was set 5 seconds. Thus, an electro-conductive elastic roller was prepared. The thickness of the elastic layer was adjusted to be 1.5 mm. The crown amount of the roller was 100 μm. The surface of the elastic roller was cut out, and observed with an electron microscope. The particle-exposing portion where Graphite particle A1 is exposed could be observed.

(4. Preparation of Coating Solution for Forming Surface Layer)

Methyl isobutyl ketone was added to a caprolactone-modified acrylic polyol solution "Placcel DC2016" (trade name, made by Daicel Corporation), and the solid content was adjusted to be 12% by mass. Four other materials shown in Component (1) in Table 4 below were added to 834 parts by mass of the solution (solid content of acrylic polyol: 100 parts by mass) to prepare a mixed solution. At this time, the block isocyanate mixture had an amount of isocyanate at "NCO/OH=1.0." Next, 188.5 g of the mixed solution was placed in a glass bottle having an inner volume of 450 mL, with 200 g of glass beads as a medium having an average particle size of 0.8 mm. Using a paint shaker dispersing machine, the mixed solution was dispersed for 20 hours. After dispersion, 7.2 g of the resin particle B1 was added. This is equivalent to 40 parts by mass of the resin particle B1 based on 100 parts by mass of solid content of the acrylic polyol. Subsequently, the resin particle B1 was dispersed for 5 minutes, and the glass beads were removed to prepare a coating solution for a surface layer. The specific gravity of the coating solution was 0.9260. The specific gravity was measured by putting a commercially available densimeter into the coating solution.

TABLE 4

| | Material | Amount in use (parts by mass) |
|---|---|---|
| Component (1) | Caprolactone-modified acrylic polyol solution (trade name: Placcel DC 2016, made by Daicel Corporation) | 100 |
| | Composite conductive fine particle (produced in Production Example C1) | 60 |
| | Surface treated titanium oxide particle (produced in Production Example C2) | 50 |
| | Modified dimethyl silicone oil (trade name: SH28PA, made by Dow Corning Toray Co., Ltd.) | 0.08 |
| | Block isocyanate mixture (7:3 mixture of butanone oxime block in hexamethylene diisocyanate (HDI) and that in isophorone diisocyanate (IPDI)) | 80.14 |
| Resin particle | Resin particle B1 | 40 |

(5. Formation of Surface Layer)

The elastic roller was directed in the longitudinal direction, vertically immersed in the coating solution, and coated by dipping. The immersion time was 9 seconds. As the take-up rate, the initial rate was 20 mm/s, and the final rate was 2 mm/s. In-between, the take-up rate was linearly changed with respect to time. The obtained coated product was air dried at 23° C. for 30 minutes, dried for one hour with a hot air circulation dryer at a temperature of 80° C., and further dried at a temperature of 160° C. for one hour to cure the coating. Thus, a charging roller 1 having a surface layer formed in the outer peripheral portion of the elastic layer was obtained. The layer thickness of the surface layer was 5.6 μm. The layer thickness of the surface layer was measured in a portion wherein no resin particle existed.

[6. Measurement of Graphite (002) Plane Lattice Spacing and Raman Spectrum Half Width]

The graphite (002) plane lattice spacing and Raman spectrum half width of the graphite particles contained in the elastic layer were measured by the methods described above. The results are shown in Tables 10-1 and 10-2.

[7. Measurement of a Variety of Properties Values of Particles Contained in Layers]

The volume average particle size of the graphite particle, the ratio of long diameter/short diameter of the graphite particle, the volume average particle size of the resin particle, the shape of the resin particle, and the proportion of the air-containing region (porosity ratio) were measured by the methods described above. Moreover, the ratio of the volume average particle size (resin particles/graphite particles) was calculated from the measurement results. The measurement results are shown in Tables 10-1 and 10-2. Moreover, the ratio of contents (parts by mass) of both particles (resin particles/graphite particles) is shown in Tables 10-1 and 10-2.

[8. Positional Relationship Between Resin Particle B1 and Graphite Particle A1 on Surface of the Elastic Layer]

The stereoscopic particle shape of Resin particle B1 was orthographically projected to the surface of the elastic layer by the method described above to examine the positional relationship. In this Example, areas other than the projected areas of Resin particles B1 in the surface layer overlapped the particle-exposing portions where Graphite particles A1 is exposed.

[9. Evaluation of Image]

A monochrome laser printer ("LBP6300" (trade name)) made by Canon Inc. as the electrophotographic apparatus having the configuration shown in FIG. 7 was modified to have a process speed of 204 mm/s. Further, voltage was applied to the charging member from the outside. The voltage applied was an AC voltage which had a peak to peak voltage (Vpp) of 1400 V and a frequency (f) of 1250 Hz. The DC voltage (Vdc) was −560 V. An image was output at a resolution of 600 dpi. The process cartridge for a printer was used as the process cartridge.

Figure 9:
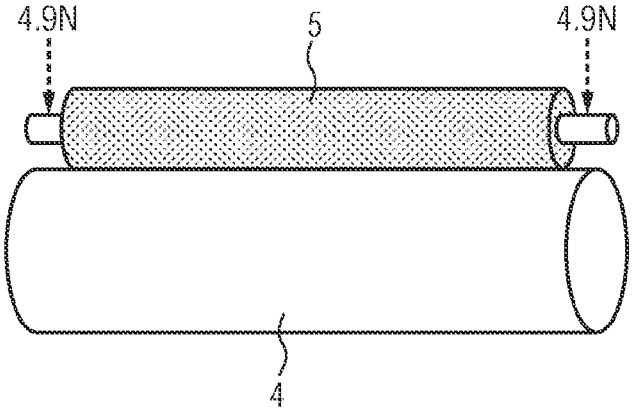
FIG. 9 is a schematic view illustrating a contact state of the charging member (in the form of a roller) according to the present invention and the electrophotographic photosensitive member.

Furthermore, the charging roller attached was removed from the process cartridge, and the charging roller 1 was mounted on the process cartridge. As shown in FIG. 9, the charging roller was brought into contact with the electrophotographic photosensitive member with springs. The pressure of 4.9 N was applied to one end of the electrophotographic photosensitive member, and the pressure of 9.8 N in total was applied to both ends thereof.

The charging roller was mounted on the process cartridge. The process cartridge was left to stand for 24 hours in any of Environment 1 (temperature: 15° C., relative humidity: 10%), Environment 2 (temperature: 23° C., relative humidity: 50%), and Environment 3 (temperature: 32.5° C., relative humidity: 80%), and was used in the respective environment to form an electrophotographic image.

In the formation of the electrophotographic image, 10,000 sheets of an image were output in which a horizontal line at a width of 2 dots and an interval of 186 dots was drawn in a direction perpendicular to the rotational direction of the electrophotographic photosensitive member. The 10,000 sheets were output on the conditions wherein the rotation of the printer was paused for 3 seconds every two outputs. Here, one sheet of a halftone image was output at each after the 2,500th sheet of the horizontal line image was output, after the 5,000th sheet was output, after the 7,500th sheet was output, and after the 10,000th sheet was output. The halftone image refers to an image in which a horizontal line at a width of one dot and an interval of three dots was drawn in the direction perpendicular to the rotational direction of the electrophotographic photosensitive member. The four halftone images thus formed (hereinafter referred to as "Halftone image Nos. 1 to 4") were visually observed to determine the rank of the moire image according to the following criteria. The charging member in this Example produced no moire image and formed a good image. The results of evaluation are shown in Tables 11-1 and 11-2.

Rank 1; no moire image is found.

Rank 2; slight moire image is found.

Rank 3; a moire image is partially found at the pitch of the charging roller, but are no problem in practice.

Rank 4; an image with remarkable moire is found, and the quality of the image is reduced.

Reduction in the discharge intensity within the nip of the charging roller in the step of forming an electrophotographic image may produce the moire image. The evaluation of the image is for checking the correlation between the effect of suppressing reduction in the discharge intensity within the nip and the quality of the electrophotographic image.

[10. Examination of Discharge Intensity within the Nip]

Figure 5:
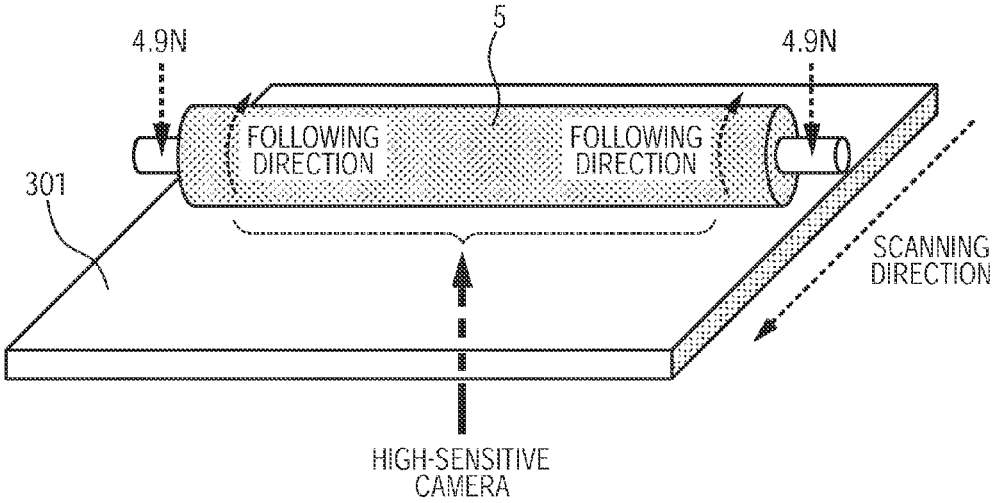
FIG. 5 is a schematic view illustrating an apparatus used for observation of the discharge within the nip in a charging member (in the form of a roller).

A 5 μm ITO film was formed on the surface of a glass plate (length: 300 mm, width: 240 mm, thickness: 4.5 mm), and further a 17 μm charge-transport layer alone was formed thereon. As shown in FIG. 5, a tool for contacting the charging roller from the surface side of a glass plate 301 by a pressure of a spring of 4.9 N at one end and 9.8 N in total was produced, and modified to scan the glass plate at the same speed as that of the durability apparatus (204 mm/s). Considering the glass plate as an electrophotographic photosensitive member, the charging roller was observed from under the contact region (opposite to the surface of the glass plate) via a high-speed gate I.I unit C9547-02 (product name, made by Hamamatsu Photonics K.K.) with a high-speed camera FASTCAM-SA1.1 (product name, made by PHOTRON LIMITED) to examine the discharge intensity within the nip of the charging roller. The voltage applied to the charging roller had the same conditions as those in the evaluation of the image (evaluation of durability). First, the charging roller before the evaluation of durability was observed, and the charging roller after the evaluation of durability was observed. Thereby, it was checked whether the discharge intensity within the nip could be kept, and the correlation with the quality of the electrophotographic image was examined.

The discharge within the nip was photographed at a photographing rate of 3000 fps for approximately 0.3 seconds. The moving picture was averaged into an image, and the image was output. In photographing, the sensitivity was properly adjusted, and the brightness of the image to be taken was adjusted. The output images were compared before and after the evaluation of durability, and determined based on the following criteria. The results of evaluation are shown in Tables 11-1 and 11-2.

The environment for observing the discharge within the nip was the environment 2. This is because in the environment 2, adhesion of the toner and the like to the surface of the charging roller is most difficult to promote, and the relationship between an increase in the electric resistance value of the charging roller and the discharge intensity within the nip is most readily examined.

Rank 1; no change in the discharge intensity within the nip is found before and after the evaluation of durability.

Rank 2; slight change in the discharge intensity within the nip is found before and after the evaluation of durability.

Rank 3; reduction in the discharge intensity within the nip is found within part of the nip before and after the evaluation of durability.

Rank 4; the discharge within the nip hardly occurs after the evaluation of durability.

[11. Measurement of Electric Resistance Value of Charging Roller]

The electric resistance value of the charging roller 1 was measured by the method described above before and after evaluation of the durability. The results are shown in Tables 11-1 and 11-2.

Examples 2 to 12

Charging rollers 2 to 12 were produced in the same manner as in Example 1 except that the types and parts by mass of the graphite particles or graphitized particles in preparation of the conductive rubber composition, and the types and parts by mass of the resin particles in preparation of the coating solution for the surface layer were changed as shown in Table 9.

Example 13

[1. Production of Elastic Roller]

An elastic roller was produced in the same manner as in Example 1 except that the type and parts by mass of the graphitized particles in preparation of the conductive rubber composition were changed as shown in Table 9.

[2. Preparation of Coating Solution for Forming Surface Layer]

Methyl isobutyl ketone was added to a caprolactone-modified acrylic polyol solution "Placcel DC2016" (trade name, made by Daicel Corporation) to adjust the solid content to be 11% by mass. Four other materials shown in Component (1) in Table 5 below were added to 714 parts by mass of the solution (acrylic polyol solid content: 100 parts by mass) to prepare a mixed solution. At this time, the block isocyanate mixture had an amount of isocyanate at "NCO/OH=1.0." Next, 187 g of the mixed solution and 200 g of glass beads as a medium having an average particle size of 0.8 mm were placed in a glass bottle having an inner volume of 450 mL, and dispersed for 24 hours using a paint shaker dispersing machine. After dispersion, 3.3 g of the resin particle B5 was added. The ratio was 20 parts by mass of the resin particle B5 based on 100 parts by mass of the acrylic polyol solid content. Subsequently, the mixture was dispersed for 5 minutes, and the glass beads were removed to prepare a coating solution for a surface layer. The specific gravity of the coating solution was 0.9190.

TABLE 5

| | Material | Amount in use (parts by mass) |
|---|---|---|
| Component (1) | Caprolactone-modified acrylic polyol solution (trade name: Placcel DC 2016, made by Daicel Corporation) | 100 |
| | Carbon black "#52" (trade name, made by Mitsubishi Chemical Corporation) | 60 |
| | Surface treated titanium oxide particle (produced in Production Example C2) | 60 |
| | Modified dimethyl silicone oil (trade name: SH28PA, made by Dow Corning Toray Co., Ltd.) | 0.08 |
| | Block isocyanate mixture (7:3 mixture of butanone oxime block in hexamethylene diisocyanate (HDI) and that in isophorone diisocyanate (IPDI)) | 80.14 |
| Resin particle | Resin particle B5 | 20 |

[3. Formation of Surface Layer]

Next, in the same manner as in Example 1, the elastic roller was immersed in the coating solution to apply the coating solution by dipping, and the coating was cured to produce Charging roller 13 having a surface layer on the outer periphery of the elastic layer.

Example 14

Charging roller 14 was produced in the same manner as in Example 13 except that the type and parts by mass of the graphitized particles in preparation of the conductive rubber composition and the type and parts by mass of the resin particles in preparation of the coating solution for the surface layer were changed as shown in Table 9.

Example 15

Charging roller 15 was produced in the same manner as in Example 14 except that in preparation of the conductive rubber composition, two Graphitized particles, that is, 7 parts by mass of Graphite particle A1 and 8 parts by mass of Graphitized particle A10 were used, and the type and parts by mass of the resin particles in preparation of the coating solution for the surface layer were changed as shown in Table 9.

Examples 16 to 24 and 26

Charging rollers 16 to 24 and 26 were produced in the same manner as in Example 15 except that the type and parts by mass of the graphite particle or graphitized particle in preparation of the conductive rubber composition and the type and parts by mass of the resin particles in preparation of the coating solution for the surface layer were changed as shown in Table 9.

Example 25

Charging roller 25 was produced in the same manner as in Example 14 except that in preparation of the conductive rubber composition, two Graphite particles, that is, 4 parts by mass of Graphite particle A7 and 4 parts by mass of Graphitized particle A20 were used, and in preparation of the coating solution for the surface layer, two Resin particles, that is, 5 parts by mass of Resin particle B8 and 5 parts by mass of Resin particle B11 were used.

Example 27

[1. Production of Elastic Roller]

A roller having a preparative coating layer was produced in the same manner as in Example 26 except that the type and parts by mass of the graphitized particles in preparation of the conductive rubber composition were changed as shown in Table 9. Next, the outer peripheral surface of the roller having a preparative coating layer was polished with a plunge cutting mode cylinder polishing machine. A vitrified grinding wheel was used as the polishing grinding wheel. The abrasive grain was a green silicon carbide (GC) having a grain size of 100 mesh. The number of rotations of the roller was 350 rpm, and the number of rotations of the polishing grinding wheel was 2050 rpm. The rotational direction of the roller had the same direction as the rotational direction of the polishing grinding wheel (following direction). The cutting speed was 20 mm/min. The spark-out time (time at a cutting amount of 0 mm) was set at 0 seconds to polish the surface of the roller. Thus, an elastic roller was produced. The crown amount was adjusted as in Example 26.

[2. Preparation of Coating Solution for Surface Layer]

Methyl ethyl ketone was added to polyvinyl butyral "S-LEC B" (trade name, made by Sekisui Chemical Co., Ltd.) to adjust the solid content to be 10% by mass. Three other materials shown in Component (1) in Table 6 below were added to 1000 parts by mass of the solution (polyvinyl butyral solid content: 100 parts by mass) to prepare a mixed solution. Next, 170 g of the mixed solution and 200 g of glass beads as a medium having an average particle size of 0.8 mm were placed in a glass bottle having an inner volume of 450 mL, and dispersed for 30 hours using a paint shaker dispersing machine. After dispersion, 7.5 g of the resin particle B14 was added. The ratio was 50 parts by mass of the resin particle B14 based on 100 parts by mass of the acrylic polyol solid content. Subsequently, the mixture was dispersed for 5 minutes, and the glass beads were removed to prepare a coating solution for a surface layer. The specific gravity of the coating solution was 0.9130.

TABLE 6

| | Material | Amount in use (parts by mass) |
|---|---|---|
| Component (1) | Polyvinyl butyral "S-LEC B" (trade name, made by Sekisui Chemical Co., Ltd.) | 100 |
| | Carbon black "#52" (trade name, made by Mitsubishi Chemical Corporation) | 60 |
| | Surface treated titanium oxide particle (produced in Production Example C2) | 60 |
| | Modified dimethyl silicone oil (trade name: SH28PA, made by Dow Corning Toray Co., Ltd.) | 0.08 |
| Resin particle | Resin particle B14 | 50 |

[3. Formation of Surface Layer]

Next, in the same manner as in Example 1, the elastic roller was immersed in the coating solution to apply the coating solution by dipping. The coating was cured to produce Charging roller 27 having a surface layer formed on the outer periphery of the elastic layer.

Examples 28 to 30

Charging rollers 28 to 30 were produced in the same manner as in Example 27 except that the type and parts by mass of the graphitized particles in preparation of the conductive rubber composition and the type and parts by mass of the resin particles in preparation of the coating solution for the surface layer were changed as shown in Table 9.

Example 31

Charging roller 31 was produced in the same manner as in Example 30 except that an epichlorohydrin rubber (Eo-EP-AGE ternary copolymer, EO/EP/AGE=56 mol %/40 mol %/4 mol %) was used as the epichlorohydrin rubber, and the type and parts by mass of the graphitized particles in preparation of the conductive rubber composition and the type and parts by mass of the resin particles in preparation of the coating solution for the surface layer were changed as shown in Table 9.

Examples 32 to 34

Charging rollers 32 to 34 were produced in the same manner as in Example 30 except that the type and parts by mass of the graphitized particle in preparation of the conductive rubber composition and the type and parts by mass of the resin particles in preparation of the coating solution for the surface layer were changed as shown in Table 9.

[Various Evaluations in Examples 2 to 34]

In the same manner as in Example 1, the particle-exposing portions where the graphite particles and/or the graphitized particles are exposed on the surface of the elastic layer were examined. The positional relationship between the resin particles in the surface layer and the graphite particles and/or the graphitized particles on the surface of the elastic layer was also examined. In all the Examples, it could be found that the surface of the elastic layer had the particle-exposing portions where one or both of the graphite particles and graphitized particles is exposed. Moreover, the surface containing the particle-exposing portions was coated with the surface layer. Furthermore, it was found that the areas other than the projected areas of the resin particles in the surface layer overlapped the particle-exposing portions where one or both of the graphite particles and the graphitized particles is exposed. The volume average particle size of the graphite particle, the ratio of long diameter/short diameter of the graphite particle, the graphite (002) plane lattice spacing, Raman spectrum half width, the volume average particle size of the resin particles, the proportion of the air-containing region of the resin particle (porosity ratio), the specific gravity of the coating solution for the surface layer, and the layer thickness of the surface layer were measured. The image was evaluated, and the discharge intensity within the nip was also examined. The electric resistance value of the charging roller was measured. The results of evaluation are shown in Tables 10-1, 10-2, 11-1 and 11-2.

Comparative Example 1

[1. Production of Elastic Roller]

An elastic roller was produced in the same manner as in Example 34 except that the graphitized particle was not used in preparation of the conductive rubber composition.

[2. Preparation of Coating Solution for Surface Layer]

Methyl ethyl ketone was added to polyvinyl butyral "S-LEC B" (trade name, made by Sekisui Chemical Co., Ltd.), and the solid content was adjusted to be 17% by mass. Two other materials shown in Components (1) in Table 7 were added to 588 parts by mass of the solution (polyvinyl butyral solid content: 100 parts by mass) to prepare a mixed solution.

Next, 169 g of the mixed solution was placed in a glass bottle having an inner volume of 450 mL together with 200 g of glass beads as a medium having an average particle size of 0.8 mm, and was dispersed for 36 hours with a paint shaker dispersing machine. After the dispersion, 2.55 g of Resin particle B16 was added. This amount corresponds to 10 parts by mass of Resin particle B16 based on 100 parts by mass of the polyvinyl butyral solid content. Subsequently, the solution was dispersed for 5 minutes, and the glass beads were removed to prepare a coating solution for the surface layer. The specific gravity of the coating solution was 0.9710.

TABLE 7

| | Material | Amount to be used (parts by mass) |
|---|---|---|
| Components (1) | Polyvinyl butyral "S-LEC B" (trade name, made by Sekisui Chemical Co., Ltd.) | 100 |
| | Carbon black "#52" (trade name, made by Mitsubishi Chemical Corporation) | 60 |
| | Modified dimethyl silicone oil (trade name, SH28PA, made by Dow Corning Toray Co., Ltd.) | 0.08 |
| Resin particles | Resin particles B16 | 10 |

[3. Formation of Surface Layer]

Next, in the same manner as in Example 1, the elastic roller was immersed in the coating solution to apply the coating solution by dipping. The coating was cured to produce Charging roller C1 having a surface layer formed on the outer periphery of the elastic layer.

[4. Evaluation]

In this Comparative Example, the particle-exposing portion where the graphitized particle is exposed could not be found on the surface of the elastic layer. As in Example 1, the results of evaluation are shown in Tables 10-2 and 11-2.

Comparative Example 2

Charging roller C2 was produced in the same manner as in Comparative Example 1 except that 30 parts by mass of Graphite particle A4 was used in preparation of the conductive rubber composition and the resin particles were not used in preparation of the coating solution for the surface layer.

In this Comparative Example, the particle-exposing portions where the graphitized particles are exposed could be found on the surface of the elastic layer. Moreover, the surface containing the particle-exposing portions was coated with the surface layer. However, no protrusions derived from resin particles were present in the surface layer. As in Example 1, the results of evaluation are shown in Tables 10-2 or 11-2.

Comparative Example 3

Charging roller C3 was produced in the same manner as in Comparative Example 1 except that 40 parts by mass of Graphitized particle A15 was used in preparation of the conductive rubber composition and the resin particles were not used in preparation of the coating solution for the surface layer. In this Comparative Example, the particle-exposing portions where the graphitized particles are exposed could be found on the surface of the elastic layer. Moreover, the surface containing the particle-exposing portions was coated with the surface layer. However, no protrusions derived from the resin particles were present in the surface layer. As in Example 1, the results of evaluation are shown in Tables 10-2 and 11-2.

Comparative Example 4

[1. Preparation of Conductive Rubber Composition]

Five other materials shown in Table 8 were added to 100 parts by mass of a butadiene rubber (BR) "JSR BR01" (trade name, made by JSR Corporation), and were kneaded for 15 minutes with a sealed type mixer adjusted to 50° C.

TABLE 8

| Materials | Amount to be used (parts by mass) |
|---|---|
| Butadiene rubber (BR) "JSR BR01" (trade name, made by JSR Corporation) | 100 |
| Carbon black (trade name: SEAST S, made by Tokai Carbon Co., Ltd.) | 40 |
| Zinc stearate (trade name: SZ-2000, made by Sakai Chemical Industry Co., Ltd.) | 1 |
| Zinc oxide (trade name: two zinc oxides, made by Sakai Chemical Industry Co., Ltd.) | 5 |
| Calcium carbonate (trade name: Silver-W, made by Shiraishi Kogyo Kaisha, Ltd.) | 20 |
| Graphitized particle A22 | 50 |

To the kneaded product, 1.2 parts by mass of sulfur as a vulcanizing agent and 4.5 parts by mass of tetrabenzylthiuram disulfide (TBzTD) (trade name: Perka Cit TBzTD, made by Flexsys America LP) as a vulcanization accelerator were added, and were kneaded for 10 minutes with a two-roll mill cooled to a temperature of 25° C. to prepare a conductive rubber composition. At this time, the interval of the two-roll mill was adjusted to 2.0 mm.

[2. Formation of Surface Layer]

Charging roller C4 was produced in the same manner as in Comparative Example 3 except that Resin particle B17 (crosslinked polymethyl methacrylate resin particles, trade name: MBX-8, made by SEKISUI PLASTICS CO., Ltd.) was used as the resin particles in preparation of the coating solution for the surface layer.

[3. Evaluation]

In this Comparative Example, the particle-exposing portions where the graphitized particles are exposed could be found on the surface of the elastic roller, and the surface containing the particle-exposing portions was coated with the surface layer. However, the areas other than the projected areas of the resin particles of the surface layer did not overlap the particle-exposing portions where the graphitized particles are exposed. As in Example 1, the results of evaluation are shown in Tables 10-2 and 11-2.

Comparative Example 5

Charging roller C5 was produced in the same manner as in Comparative Example 4 except that Resin particle B18 (crosslinked polymethyl methacrylate resin particles, trade name: MBX-12, made by SEKISUI PLASTICS CO., Ltd.) was used as the resin particles in preparation of the coating solution for the surface layer. In this Comparative Example, the particle-exposing portions where the graphitized particles are exposed could be found on the surface of the elastic roller, and the surface containing the particle-exposing portions was coated with the surface layer. However, the areas other than the projected areas of the resin particles of the surface layer did not overlap the particle-exposing portions where the graphitized particles are exposed. As in Example 1, the results of evaluation are shown in Tables 10-2 and 11-2.

Comparative Example 6

The same conductive rubber composition as that in Example 32 was placed in a metal mold having a cylindrical cavity in which an electro-conductive substrate was set. The metal mold was heated for 30 minutes in a hot air furnace at 160° C. At this time, a metal mold having an outer diameter of ϕ9 mm was used. Subsequently, after the product was released from the metal mold, the product was heated in the hot air furnace at 160° C. for 10 minutes to perform a secondary vulcanization to produce an elastic roller. At this time, the particle-exposing portions where the graphite particles are exposed could not be found. Subsequently, Charging roller C6 was produced in the same manner as in Example 31. As in Example 1, the results of evaluation are shown in Tables 10-2 and 11-2.

TABLE 9

| | Graphite particle and Graphitized particle | | Resin particle | |
|---|---|---|---|---|
| | Type | Parts by mass | Type | Parts by mass |
| Example 1 | Graphite particle A1 | 20 | Resin particle B1 | 40 |
| Example 2 | Graphite particle A2 | 10 | Resin particle B1 | 40 |
| Example 3 | Graphite particle A3 | 20 | Resin particle B1 | 40 |
| Example 4 | Graphite particle A4 | 20 | Resin particle B2 | 20 |
| Example 5 | Graphitized particle A8 | 20 | Resin particle B1 | 50 |
| Example 6 | Graphite particle A16 | 30 | Resin particle B4 | 40 |
| Example 7 | Graphite particle A17 | 30 | Resin particle B2 | 20 |
| Example 8 | Graphite particle A2 | 10 | Resin particle B3 | 60 |
| Example 9 | Graphite particle A5 | 30 | Resin particle B3 | 40 |
| Example 10 | Graphitized particle A10 | 10 | Resin particle B1 | 50 |
| Example 11 | Graphitized particle A13 | 10 | Resin particle B1 | 40 |
| Example 12 | Graphitized particle A14 | 20 | Resin particle B1 | 40 |
| Example 13 | Graphitized particle A19 | 30 | Resin particle B5 | 20 |
| Example 14 | Graphitized particle A9 | 20 | Resin particle B4 | 50 |
| Example 15 | Graphite particle A1 + Graphitized particle A10 | 15 | Resin particle B3 | 60 |
| Example 16 | Graphite particle A2 | 20 | Resin particle B6 | 75 |
| Example 17 | Graphite particle A6 | 10 | Resin particle B7 | 100 |
| Example 18 | Graphite particle A6 | 15 | Resin particle B8 | 100 |
| Example 19 | Graphite particle A6 | 10 | Resin particle B9 | 10 |
| Example 20 | Graphite particle A7 | 40 | Resin particle B9 | 20 |
| Example 21 | Graphite particle A7 | 40 | Resin particle B8 | 100 |
| Example 22 | Graphitized particle A20 | 50 | Resin particle B10 | 20 |
| Example 23 | Graphitized particle A11 | 30 | Resin particle B11 | 80 |
| Example 24 | Graphitized particle A15 | 30 | Resin particle B12 | 30 |
| Example 25 | Graphite particle A7 + Graphitized particle A20 | 8 | Resin particle B8 + Resin particle B11 | 10 |
| Example 26 | Graphitized particle A21 | 5 | Resin particle B13 | 80 |
| Example 27 | Graphitized particle A22 | 30 | Resin particle B14 | 50 |
| Example 28 | Graphitized particle A23 | 30 | Resin particle B14 | 100 |
| Example 29 | Graphite particle A6 | 8 | Resin particle B15 | 100 |
| Example 30 | Graphitized particle A12 | 10 | Resin particle B16 | 7 |
| Example 31 | Graphitized particle A24 | 30 | Resin particle B16 | 10 |
| Example 32 | Graphitized particle A18 | 40 | Resin particle B15 | 5 |
| Example 33 | Graphitized particle A25 | 10 | Resin particle B15 | 100 |
| Example 34 | Graphitized particle A25 | 50 | Resin particle B16 | 50 |
| Comparative Example 1 | — | 0 | Resin particle B16 | 10 |
| Comparative Example 2 | Graphite particle A4 | 30 | — | 0 |
| Comparative Example 3 | Graphitized particle A15 | 40 | — | 0 |
| Comparative Example 4 | Graphitized particle A22 | 50 | Resin particle B17 | 50 |
| Comparative Example 5 | Graphitized particle A22 | 50 | Resin particle B18 | 50 |
| Comparative Example 6 | Graphitized particle A24 | 30 | Resin particle B16 | 10 |

TABLE 10

| | Graphite particle and Graphitized particle | | | | Resin particle | | | Ratio of | | | |
|---|---|---|---|---|---|---|---|---|---|---|---|
| | Volume average particle size (μm) | Ratio of long diameter/short diameter | Graphite (002) plane lattice spacing (nm) | Half width ($cm^{-1}$) | Volume average particle size (μm) | Shape of particle | Proportion of air-containing region (%) | volume average particle size (resin/graphite) | Ratio of content (resin/graphite) | Specific gravity of surface layer coating solution | Layer thickness of surface layer (μm) |
| Example 1 | 6 | 1.8 | 0.3354 | 18 | 29.9 | Porous | 0.91 | 5.0 | 2.0 | 0.926 | 5.6 |
| Example 2 | 3.1 | 1.9 | 0.3355 | 19 | 29.9 | Porous | 0.85 | 10.0 | 4.0 | 0.926 | 6.1 |
| Example 3 | 10.2 | 2 | 0.3356 | 22 | 29.9 | Porous | 1.0 | 3.0 | 2.0 | 0.926 | 5.8 |
| Example 4 | 10.1 | 2 | 0.3354 | 21 | 20.0 | Porous | 1.2 | 2.0 | 1.0 | 0.925 | 5.3 |
| Example 5 | 3.1 | 2.3 | 0.336 | 24 | 29.9 | Porous | 1.1 | 10.0 | 2.5 | 0.928 | 6.2 |
| Example 6 | 41 | 2 | 0.3357 | 21 | 35.3 | Porous | 0.72 | 0.9 | 1.3 | 0.927 | 5.8 |
| Example 7 | 49 | 2 | 0.3358 | 21 | 20.0 | Porous | 0.63 | 0.4 | 0.7 | 0.925 | 5.5 |
| Example 8 | 3.1 | 1.9 | 0.3354 | 20 | 18.2 | Porous | 0.61 | 6.1 | 6.0 | 0.930 | 6.2 |
| Example 9 | 39 | 2.1 | 0.3355 | 19 | 18.2 | Porous | 0.66 | 0.5 | 1.3 | 0.926 | 5.9 |
| Example 10 | 6.1 | 2.1 | 0.3361 | 23 | 29.9 | Porous | 0.89 | 5.0 | 5.0 | 0.928 | 6.0 |
| Example 11 | 3.5 | 1.2 | 0.3363 | 25 | 29.9 | Porous | 0.98 | 8.5 | 4.0 | 0.926 | 5.8 |
| Example 12 | 8.1 | 1.3 | 0.3362 | 26 | 29.9 | Porous | 0.91 | 3.7 | 2.0 | 0.926 | 5.8 |
| Example 13 | 52 | 1.5 | 0.3365 | 29 | 35.2 | Multi-hollow | 25 | 0.7 | 0.7 | 0.919 | 4.8 |
| Example 14 | 3.1 | 2.2 | 0.3359 | 23 | 35.3 | Porous | 1.1 | 11.8 | 2.5 | 0.921 | 4.3 |
| Example 15 | 5.9 | 2.1 | 0.3359 | 22 | 29.9 | Porous | 0.85 | 5.0 | 4.0 | 0.923 | 5.0 |
| Example 16 | 3 | 1.9 | 0.3354 | 19 | 40.5 | Multi-hollow | 30 | 13.5 | 3.8 | 0.925 | 4.6 |
| Example 17 | 2.1 | 2.2 | 0.3355 | 21 | 47.5 | Porous | 1.2 | 23.8 | 10.0 | 0.930 | 5.5 |
| Example 18 | 2.1 | 2.1 | 0.3354 | 22 | 49.3 | Porous | 1.1 | 24.7 | 6.7 | 0.930 | 5.2 |
| Example 19 | 2.2 | 2 | 0.3355 | 23 | 10.0 | Porous | 0.76 | 5.0 | 1.0 | 0.918 | 4.2 |
| Example 20 | 67 | 2.5 | 0.3355 | 22 | 10.0 | Porous | 0.67 | 0.1 | 0.5 | 0.919 | 4.3 |
| Example 21 | 67 | 2.5 | 0.3355 | 22 | 49.3 | Porous | 1.1 | 0.7 | 2.5 | 0.930 | 5.1 |
| Example 22 | 61 | 1.8 | 0.3365 | 28 | 18.1 | Solid | 0 | 0.3 | 0.4 | 0.918 | 5.5 |
| Example 23 | 49 | 2.3 | 0.3361 | 23 | 49.9 | Multi-hollow | 33 | 1.0 | 2.7 | 0.950 | 5.2 |
| Example 24 | 48 | 1.5 | 0.3363 | 24 | 11.8 | Solid | 0 | 0.2 | 1.0 | 0.951 | 5.6 |
| Example 25 | 62 | 2.4 | 0.3362 | 26 | 49.3 | Porous + Multi-hollow | 15 | 0.8 | 1.3 | 0.952 | 5.5 |
| Example 26 | 3.2 | 1.4 | 0.3376 | 39 | 59.2 | Porous | 0.95 | 19.7 | 16.0 | 0.953 | 5.3 |
| Example 27 | 2.3 | 1.2 | 0.3441 | 56 | 45.0 | Multi-hollow | 37 | 22.5 | 1.7 | 0.913 | 3.5 |
| Example 28 | 70 | 1.2 | 0.3432 | 55 | 45.0 | Multi-hollow | 35 | 0.6 | 3.3 | 0.918 | 4.5 |
| Example 29 | 2.5 | 2 | 0.3355 | 22 | 61.8 | Multi-hollow | 29 | 30.9 | 12.5 | 0.918 | 4.1 |
| Example 30 | 2.1 | 2.2 | 0.3362 | 26 | 8.0 | Porous | 0.72 | 4.0 | 0.7 | 0.909 | 2.1 |
| Example 31 | 92 | 1.9 | 0.3583 | 80 | 8.0 | Porous | 0.68 | 0.1 | 0.3 | 0.910 | 2.4 |
| Example 32 | 94 | 1.8 | 0.3365 | 32 | 61.8 | Multi-hollow | 30 | 0.7 | 0.1 | 0.909 | 3.3 |
| Example 33 | 70 | 2.2 | 0.3654 | 80 | 62.0 | Multi-hollow | 29 | 0.9 | 10.0 | 0.918 | 3.5 |
| Example 34 | 71 | 2.2 | 0.3652 | 81 | 8.0 | Porous | 0.73 | 0.1 | 1.0 | 0.914 | 2.5 |
| Comparative Example 1 | — | — | — | — | 8.0 | Porous | 0.86 | — | — | 0.972 | 16.1 |
| Comparative Example 2 | 10.2 | 2 | 0.3355 | 23 | 0.0 | — | — | 0.0 | 0.0 | 0.971 | 15.7 |
| Comparative Example 3 | 50 | 1.5 | 0.3363 | 25 | 0.0 | — | — | 0.0 | 0.0 | 0.971 | 15.7 |
| Comparative Example 4 | 2.1 | 1.2 | 0.3421 | 58 | 8.2 | Solid | 0 | 4.1 | 1.0 | 0.973 | 16.3 |
| Comparative Example 5 | 2.1 | 1.2 | 0.3421 | 55 | 11.8 | Solid | 0 | 5.9 | 1.0 | 0.973 | 16.5 |
| Comparative Example 6 | 90 | 2 | 0.3584 | 80 | 8.0 | Porous | 0.68 | 0.1 | 0.3 | 0.910 | 2.4 |

TABLE 11

| | Evaluation of image | | | | | | | | | | | | | Electric resistance value of charging roller | | |
|---|---|---|---|---|---|---|---|---|---|---|---|---|---|---|---|---|
| | Environment 1 Halftone No. | | | | Environment 2 Halftone No. | | | | Environment 3 Halftone No. | | | | Discharge intensity | before durability test Ω | after durability test Ω | Rate of change |
| | 1 | 2 | 3 | 4 | 1 | 2 | 3 | 4 | 1 | 2 | 3 | 4 | within nip | ($\times 10^5$) | ($\times 10^5$) | (%) |
| Example 1 | 1 | 1 | 1 | 1 | 1 | 1 | 1 | 1 | 1 | 1 | 1 | 1 | 1 | 5.0 | 5.4 | 8 |
| Example 2 | 1 | 1 | 1 | 1 | 1 | 1 | 1 | 1 | 1 | 1 | 1 | 1 | 1 | 5.3 | 5.8 | 9 |
| Example 3 | 1 | 1 | 1 | 1 | 1 | 1 | 1 | 1 | 1 | 1 | 1 | 1 | 1 | 5.0 | 5.9 | 18 |
| Example 4 | 1 | 1 | 1 | 1 | 1 | 1 | 1 | 1 | 1 | 1 | 1 | 1 | 1 | 4.3 | 5.0 | 16 |
| Example 5 | 1 | 1 | 1 | 1 | 1 | 1 | 1 | 1 | 1 | 1 | 1 | 1 | 1 | 5.2 | 5.8 | 12 |
| Example 6 | 1 | 1 | 1 | 1 | 1 | 1 | 1 | 1 | 1 | 1 | 1 | 1 | 1 | 6.1 | 6.7 | 10 |
| Example 7 | 1 | 1 | 1 | 1 | 1 | 1 | 1 | 1 | 1 | 1 | 1 | 1 | 1 | 4.3 | 5.0 | 16 |
| Example 8 | 1 | 1 | 1 | 1 | 1 | 1 | 1 | 1 | 1 | 1 | 1 | 1 | 1 | 3.2 | 3.8 | 19 |
| Example 9 | 1 | 1 | 1 | 1 | 1 | 1 | 1 | 1 | 1 | 1 | 1 | 1 | 1 | 3.3 | 3.9 | 18 |
| Example 10 | 1 | 1 | 1 | 1 | 1 | 1 | 1 | 1 | 1 | 1 | 1 | 1 | 1 | 5.4 | 6.4 | 19 |
| Example 11 | 1 | 1 | 1 | 1 | 1 | 1 | 1 | 1 | 1 | 1 | 1 | 1 | 1 | 5.8 | 6.5 | 12 |
| Example 12 | 1 | 1 | 1 | 1 | 1 | 1 | 1 | 1 | 1 | 1 | 1 | 1 | 1 | 5.4 | 6.1 | 13 |
| Example 13 | 1 | 1 | 1 | 1 | 1 | 1 | 1 | 1 | 1 | 1 | 1 | 1 | 1 | 6.3 | 7.0 | 11 |
| Example 14 | 1 | 1 | 1 | 1 | 1 | 1 | 1 | 1 | 1 | 1 | 1 | 1 | 1 | 7.1 | 7.8 | 10 |
| Example 15 | 1 | 1 | 1 | 1 | 1 | 1 | 1 | 1 | 1 | 1 | 1 | 1 | 1 | 5.7 | 6.8 | 19 |
| Example 16 | 1 | 1 | 1 | 2 | 1 | 1 | 1 | 2 | 1 | 1 | 1 | 1 | 2 | 7.1 | 9.0 | 27 |
| Example 17 | 1 | 1 | 2 | 2 | 1 | 1 | 1 | 2 | 1 | 1 | 1 | 1 | 2 | 6.9 | 8.9 | 29 |
| Example 18 | 1 | 1 | 2 | 2 | 1 | 1 | 2 | 2 | 1 | 1 | 1 | 1 | 2 | 6.5 | 8.9 | 37 |
| Example 19 | 1 | 1 | 2 | 2 | 1 | 1 | 2 | 2 | 1 | 1 | 1 | 1 | 2 | 4.3 | 6.2 | 44 |
| Example 20 | 1 | 2 | 2 | 2 | 1 | 1 | 2 | 2 | 1 | 1 | 1 | 1 | 2 | 4.2 | 6.1 | 45 |
| Example 21 | 1 | 2 | 2 | 2 | 1 | 2 | 2 | 2 | 1 | 1 | 1 | 2 | 2 | 6.3 | 8.9 | 41 |
| Example 22 | 2 | 2 | 2 | 3 | 1 | 2 | 2 | 3 | 1 | 1 | 1 | 2 | 3 | 5.5 | 9.0 | 64 |
| Example 23 | 2 | 2 | 2 | 2 | 1 | 2 | 2 | 2 | 1 | 1 | 1 | 2 | 2 | 6.5 | 8.8 | 35 |
| Example 24 | 2 | 2 | 2 | 3 | 1 | 2 | 2 | 3 | 1 | 1 | 1 | 2 | 3 | 6.5 | 10.5 | 62 |
| Example 25 | 2 | 2 | 2 | 2 | 1 | 2 | 2 | 2 | 1 | 1 | 1 | 2 | 2 | 7.4 | 10.8 | 46 |
| Example 26 | 2 | 2 | 3 | 2 | 2 | 2 | 2 | 3 | 1 | 1 | 2 | 2 | 3 | 7.6 | 13.0 | 71 |
| Example 27 | 1 | 2 | 3 | 3 | 2 | 2 | 2 | 3 | 1 | 2 | 2 | 2 | 3 | 5.4 | 9.5 | 76 |
| Example 28 | 2 | 2 | 3 | 3 | 2 | 2 | 2 | 3 | 1 | 1 | 2 | 3 | 3 | 5.3 | 9.2 | 74 |
| Example 29 | 2 | 2 | 3 | 3 | 3 | 3 | 3 | 3 | 2 | 2 | 2 | 3 | 3 | 5.5 | 9.5 | 73 |
| Example 30 | 1 | 3 | 3 | 3 | 3 | 3 | 3 | 3 | 2 | 2 | 2 | 3 | 3 | 2.5 | 4.8 | 92 |
| Example 31 | 2 | 3 | 3 | 3 | 3 | 3 | 3 | 3 | 2 | 2 | 3 | 3 | 3 | 2.5 | 4.5 | 80 |
| Example 32 | 3 | 3 | 3 | 3 | 3 | 3 | 3 | 3 | 3 | 2 | 3 | 3 | 3 | 2.6 | 4.6 | 77 |
| Example 33 | 3 | 3 | 3 | 3 | 3 | 3 | 3 | 3 | 3 | 3 | 3 | 3 | 3 | 3.8 | 7.3 | 92 |
| Example 34 | 3 | 3 | 3 | 3 | 3 | 3 | 3 | 3 | 3 | 3 | 3 | 3 | 3 | 3.2 | 5.5 | 72 |
| Comparative Example 1 | 3 | 3 | 4 | 4 | 3 | 4 | 4 | 4 | 2 | 3 | 4 | 4 | 4 | 3.2 | 6.1 | 91 |
| Comparative Example 2 | 4 | 4 | 4 | 4 | 4 | 4 | 4 | 4 | 4 | 4 | 4 | 4 | 4 | 2.3 | 8.9 | 287 |
| Comparative Example 3 | 4 | 4 | 4 | 4 | 4 | 4 | 4 | 4 | 4 | 4 | 4 | 4 | 4 | 2.3 | 10.0 | 335 |
| Comparative Example 4 | 4 | 4 | 4 | 4 | 4 | 4 | 4 | 4 | 4 | 4 | 4 | 4 | 4 | 3.6 | 15.0 | 317 |
| Comparative Example 5 | 3 | 3 | 4 | 4 | 3 | 3 | 4 | 4 | 3 | 3 | 4 | 4 | 4 | 3.3 | 19.0 | 476 |
| Comparative Example 6 | 2 | 4 | 4 | 4 | 3 | 4 | 4 | 4 | 2 | 4 | 4 | 4 | 4 | 3.0 | 11.0 | 267 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-014859, filed Jan. 29, 2013, which is hereby incorporated by reference herein in its entirety.

REFERENCE SIGNS LIST

1. electro-conductive substrate
2. electro-conductive elastic layer
3. electro-conductive surface layer
4. electrophotographic photosensitive member
5. charging member (charging roller)
101, 102, 103. graphite particle or graphitized particle
104. resin particle
105. exposing portion where graphite particle or graphitized particle is exposed

What is claimed is:

1. A charging member comprising:
an electro-conductive substrate,
an electro-conductive elastic layer, and
an electro-conductive surface layer,
wherein, the elastic layer comprises:
a polymer having a unit derived from ethylene oxide, and
at least one particle selected from the group consisting of graphite particles and graphitized particles,
wherein,
a particle-exposing portion where one or both of the particles selected from the group consisting of the graphite particles and the graphitized particles is exposed, is present on the surface of the elastic layer,
the surface of the elastic layer including the particle-exposing portions where one or both of the particles selected from the group consisting of the graphite particles and the graphitized particles is exposed, is coated with the surface layer,
the surface layer
comprises:
a binder resin, and
resin particles dispersed in the binder resin, and
has a plurality of protrusions derived from the resin particles on the surface of the surface layer,
and wherein,
when the resin particles in the surface layer are orthographically projected onto the surface of the elastic layer, areas other than projected areas of the resin particles on the surface of the elastic layer overlap the particle-exposing portions where one or both of the particles selected from the group consisting of the graphite particles and the graphitized particles is exposed on the surface of the elastic layer.

2. The charging member according to claim 1, wherein the resin particle has a plurality of pores having air-containing regions inside thereof.

3. The charging member according to claim 1, wherein the graphite particles and the graphitized particles have a graphite (002) plane lattice spacing of 0.3354 nm or more and 0.3365 nm or less.

4. The charging member according to claim 1, wherein the graphite particles are natural graphites.

5. The charging member according to claim 1, wherein the graphite particles have a volume average particle size of 1 μm or more and 150 μm or less.

6. The charging member according to claim 5, wherein the graphite particles have a volume average particle size of 2 μm or more and 100 μm or less.

7. The charging member according to claim 1, wherein the graphitized particles are prepared by calcining a bulk mesophase pitch.

8. The charging member according to claim 1, wherein the graphitized particles are prepared by calcining mesocarbon microbeads.

9. The charging member according to claim 1, wherein the graphitized particles have a volume average particle size of 1 μm or more and 150 μm or less.

10. The charging member according to claim 9, wherein the graphitized particles have a volume average particle size of 2 μm or more and 100 μm or less.

11. A process cartridge, comprising the charging member according to claim 1 integrated with a charged member, wherein the process cartridge is detachably mountable to a main body of an electrophotographic apparatus.

12. An electrophotographic apparatus comprising the charging member according to claim 1, and an electrophotographic photosensitive member disposed to be chargeable with the charging member.

* * * * *